US009409182B2

(12) United States Patent
Carson et al.

(10) Patent No.: US 9,409,182 B2
(45) Date of Patent: Aug. 9, 2016

(54) SHREDDER WITH PAPER SEPARATION AND ADVANCEMENT MECHANISM

(71) Applicant: Fellowes, Inc., Itasca, IL (US)

(72) Inventors: Steven Carson, River Forest, IL (US); Tai Hoon K. Matlin, Round Lake Beach, IL (US); Shawn Michael Applegate, Wood Dale, IL (US); Dennis William Gruber, Arlington Heights, IL (US); Dipan Pravin Surati, Des Plaines, IL (US)

(73) Assignee: FELLOWES, INC., Itasca, IL (US)

( * ) Notice: Subject to any disclaimer, the term of this patent is extended or adjusted under 35 U.S.C. 154(b) by 642 days.

(21) Appl. No.: 13/842,917

(22) Filed: Mar. 15, 2013

(65) Prior Publication Data

US 2014/0263774 A1 Sep. 18, 2014

(51) Int. Cl.

| | |
|---|---|
| ***B02C 18/22*** | (2006.01) |
| ***B02C 18/00*** | (2006.01) |
| *B65H 3/32* | (2006.01) |

(52) U.S. Cl.

CPC ..... *B02C 18/2258* (2013.01); *B02C 18/0007* (2013.01); *B02C 18/2225* (2013.01); *B65H 3/322* (2013.01)

(58) Field of Classification Search

CPC ..... B02C 18/2258; B02C 18/2225; B02C 18/0007; B02C 2018/0069; B02C 18/16; B02C 19/00; B02C 23/00; B65H 3/322; B65H 2301/5127

See application file for complete search history.

(56) References Cited

U.S. PATENT DOCUMENTS 4,192,467 A * 3/1980 Hatanaka ..... B02C 18/0007 241/100
4,231,530 A 11/1980 Hatanaka
4,232,860 A 11/1980 Brown (Continued)

FOREIGN PATENT DOCUMENTS

CN 1053778 A 8/1991
CN 1577132 A 2/2005

(Continued)

OTHER PUBLICATIONS

International Preliminary Report on Patentability mailed Sep. 24, 2015 in International Application PCT/US2014/014667.

(Continued)

*Primary Examiner* — Alexander P Taousakis
*Assistant Examiner* — Leonel Vasquez
(74) *Attorney, Agent, or Firm* — Pillsbury Winthrop Shaw Pittman LLP

(57) ABSTRACT

The present disclosure is generally related to an apparatus having cutter elements for destroying articles such as paper sheets and a mechanism for separating at least a sheet from a stack in a tray. The separation mechanism can be activated by rotation of the cutter elements. In one embodiment, the separation mechanism is provided in the form of a helical mechanism, such as a coil, configured for insertion into the stack and to receive separated sheets from the stack in between its spaces as it is rotated. The separated sheets can fall via gravity into the shredder mechanism. Optionally, a paper feed mechanism can feed separated paper to the cutter elements. The tray can include an edge to assist in directing separated paper towards the cutter elements. One or more staple picking support mechanisms can also be provided to assist in separating sheets from a stapled set of pages.

42 Claims, 21 Drawing Sheets

(56) References Cited

U.S. PATENT DOCUMENTS

| | | | | |
|---|---|---|---|---|
| 4,529,134 | A | 7/1985 | Williams | |
| 4,815,669 | A | 3/1989 | Fujii | |
| 4,815,670 | A | 3/1989 | Iwai | |
| 4,817,877 | A | 4/1989 | Itoh et al. | |
| 4,821,967 | A | 4/1989 | Moriyama | |
| 4,878,626 | A | 11/1989 | Leuthold et al. | |
| 4,893,759 | A | 1/1990 | Mizobata | |
| 4,957,243 | A | 9/1990 | Kanagaki et al. | |
| 4,986,481 | A | 1/1991 | Fujii et al. | |
| 5,009,410 | A * | 4/1991 | Fujii | B02C 18/0007 271/127 |
| 5,188,301 | A | 2/1993 | Hasegawa | |
| 5,261,614 | A | 11/1993 | Schwelling | |
| 5,362,002 | A | 11/1994 | Tsai | |
| 5,441,249 | A | 8/1995 | Todaro et al. | |
| 5,538,193 | A | 7/1996 | Takahashi et al. | |
| 5,662,280 | A | 9/1997 | Nishio et al. | |
| 5,743,473 | A | 4/1998 | Gregg | |
| 5,772,129 | A | 6/1998 | Nishio et al. | |
| 5,871,162 | A | 2/1999 | Rajewski | |
| 5,884,855 | A | 3/1999 | Chang | |
| 5,954,279 | A | 9/1999 | Siegfried et al. | |
| 6,332,607 | B1 | 12/2001 | Van Der Werff | |
| 6,390,397 | B1 | 5/2002 | Ko | |
| 6,502,812 | B2 * | 1/2003 | Belec | B65H 3/08 270/52.02 |
| 7,040,559 | B2 | 5/2006 | Matlin et al. | |
| 7,500,625 | B2 | 3/2009 | Castronovo | |
| 7,500,627 | B2 | 3/2009 | Park et al. | |
| 7,823,873 | B1 | 11/2010 | Su | |
| 7,828,235 | B2 * | 11/2010 | Matlin | B02C 18/0007 241/100 |
| 7,963,472 | B2 | 6/2011 | Odman et al. | |
| 8,123,152 | B2 * | 2/2012 | Matlin | B02C 18/0007 241/100 |
| 8,167,223 | B2 | 5/2012 | Jensen et al. | |
| 2001/0011793 | A1 | 8/2001 | Suzuki et al. | |
| 2002/0070300 | A1 | 6/2002 | McLean et al. | |
| 2002/0190146 | A1 | 12/2002 | Irwin | |
| 2004/0135305 | A1 | 7/2004 | Bagrosky | |
| 2005/0023745 | A1 | 2/2005 | Morimoto et al. | |
| 2005/0072870 | A1 | 4/2005 | Deziesinski et al. | |
| 2005/0230897 | A1 * | 10/2005 | Canini | B65H 3/322 270/58.08 |
| 2005/0274836 | A1 | 12/2005 | Chang | |
| 2006/0054727 | A1 | 3/2006 | Ko | |
| 2006/0179987 | A1 | 8/2006 | Park et al. | |
| 2006/0249609 | A1 | 11/2006 | Huang | |
| 2007/0181722 | A1 | 8/2007 | Dahle et al. | |
| 2007/0235573 | A1 | 10/2007 | Johnson | |
| 2008/0179436 | A1 | 7/2008 | Kuraoka | |
| 2008/0197220 | A1 | 8/2008 | Tsai | |
| 2008/0210794 | A1 | 9/2008 | Schwelling et al. | |
| 2009/0008871 | A1 | 1/2009 | Omi | |
| 2010/0032505 | A1 * | 2/2010 | Jensen | B02C 18/0007 241/25 |
| 2011/0056952 | A1 | 3/2011 | Borowski et al. | |
| 2011/0165035 | A1 | 7/2011 | Lewis et al. | |
| 2011/0204168 | A1 | 8/2011 | Su | |
| 2013/0134244 | A1 | 5/2013 | Gao et al. | |
| 2014/0103151 | A1 * | 4/2014 | Xu | B65H 3/047 241/28 |

FOREIGN PATENT DOCUMENTS

| | | | | |
|---|---|---|---|---|
| CN | 201231172 | Y | 5/2009 | |
| CN | 201470445 | U | 5/2010 | |
| CN | 201735438 | U | 2/2011 | |
| DE | 3219693 | A | 12/1983 | |
| DE | 3814424 | A1 | 11/1989 | |
| DE | 3215380 | C2 | 8/1993 | |
| DE | 9400310 | U1 | 5/1994 | |
| EP | 0281136 | B1 | 9/1988 | |
| GB | 2174369 | A * | 11/1986 | B65H 3/322 |
| WO | 2008095693 | A1 | 8/2008 | |
| WO | 2009017885 | A1 | 2/2009 | |
| WO | 2009035178 | A1 | 3/2009 | |

OTHER PUBLICATIONS

German Office Action for German Application No. 11200800184035, dated Aug. 7, 2012, 7 pages.

Great Britain Examination Report for Great Britain Application No. GB1000398.6, dated Jul. 27, 2011, 5 pages.

Great Britain Examination Report for Great Britain Application No. GB1115499.4, dated Jan. 9, 2012, 4 pages.

Chinese Office Action for Chinese Application No. 201110278800.6, dated May 22, 2013, 10 pages.

International Search Report and Written Opinion issued on Jul. 16, 2014 in PCT Application No. PCT/US2014/014667.

International Search Report dated Dec. 4, 2013 for International Application No. PCT/US2013/062266 (four pages).

Written Opinion of the International Searching Authority (Form PCT/ISA/237) dated Dec. 4, 2013, for International Application No. PCT/US2013/062266 (five pages).

International Preliminary Report on Patentability issued Apr. 21, 2015 in International Application PCT/US2013/062266.

International Preliminary Report on Patentability for PCT International Patent Application No. PCT/US2008/0665311, mailed Mar. 31, 2011, 17 pages.

International Search Report, International Search Report and Written Opinion for PCT International Patent Application No. PCT/US2008/0665311 mailed Oct. 22, 2008, 17 pages.

Rexel SHRD UK/EU Rexel Auto+ C/C shredder product description and datasheet from Rexel website, obtained from <url: http://www.rexeleurope.com/rexel/en/gb/p/217/2101998/shrd+uk-eu+rexel+auto%2b+c-c.aspx>, obtained Aug. 21, 2009, 2 pages.

Office Action issued on Mar. 4, 2015 in U.S. Appl. No. 13/652,363.

* cited by examiner

SECTION 10-10

SHREDDER WITH PAPER SEPARATION AND ADVANCEMENT MECHANISM

BACKGROUND

1. Field

The present disclosure is generally related to an apparatus having cutter elements for destroying documents such as paper sheets. In particular, the apparatus comprises an advancement mechanism for advancing at least one sheet from a stack of paper in a tray into the cutter elements for shredding.

2. Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. No. 7,040,559.

Prior art shredders have a predetermined amount of capacity or amount of paper that can be shredded in one pass between the cutter elements. Typically, the sheets of paper are fed into the shredder mechanism manually. Thus, when an operator needs to shred, he or she can only shred a number of sheets of paper by manually inserting one or more sheets one pass at a time. Examples of such shredders are shown in U.S. Pat. Nos. 4,192,467, 4,231,530, 4,232,860, 4,821,967, 4,986,481, 5,188,301, 5,261,614, 5,362,002, 5,662,280, 5,772,129, 5,884,855, and 6,390,397 B1 and U.S. Patent Application Publications 2005/0274836 A1, 2006/0179987 A1, and 2006/0249609 A1, which are hereby incorporated by reference in their entirety.

With manual feed shredders, the user would have to spend time feeding smaller portions of the stack manually, thus taking away from productivity time. Other shredders are designed for automatic feeding. The shredder will include a bin in which a state of documents can be placed. A feeding mechanism can then feed the documents from the stack into the shredding mechanism.

This type of shredder is desirable in an office setting for productivity reasons, as the user can leave the stack in the bin and leave the shredder to do its work. For example, U.S. Pat. Nos. 4,815,699, 5,009,410, 7,500,627 B2, 7,828,235 B2, 8,123,152 B2, and 8,167,223 B2 and U.S. Patent Application Publication 2009/0008871 A1 and foreign Publications WO 2008/095693 A1 and WO 2009/035178 A1, each of which is hereby incorporated by reference in their entirety, describe shredders with such feed mechanisms. A shredding device that can effectively separate paper within a stack without causing damage to the cutters or stopping the machine is desirable.

SUMMARY

One aspect of the disclosure provides a shredder having: a housing; a paper shredder mechanism received in the housing and including a Motor and cutter elements, the motor rotating the cutter elements in an interleaving relationship for shredding paper sheets fed therein; a tray for holding a stack of paper sheets to be fed into the cutter elements; a paper stack separation mechanism positioned adjacent to the tray, the paper stack separation mechanism configured for insertion into at least part of the stack and rotation to separate at least an edge of at least one paper sheet therefrom and for advancing the at least one separated paper sheet towards the cutter elements. The paper stack separation mechanism is configured for rotation about a rotational axis that is substantially perpendicular to the axes of the cutter elements. A drive system is constructed to drive the paper stack separation mechanism in an advancing direction to advance the at least one separated paper sheet from the stack and towards the cutter elements.

Another aspect of the disclosure provides a method for advancing paper sheets into cutter elements for shredding. The method includes:

providing a tray for holding a stack of paper sheets;

providing a paper stack separation mechanism to separate one or more paper sheets from the stack;

rotating cutter elements in an interleaving relationship about parallel and horizontal axes for shredding paper sheets fed therein;

rotating the paper stack separation mechanism for insertion into the stack to separate one or more paper sheets for advancing towards the cutter elements, the rotation being about a rotational axis that is substantially perpendicular to the axes of the cutter elements, and driving the paper stack separation mechanism in an advancing direction to advance the one or more separated paper sheets towards the cutter elements.

Other features and advantages of the present disclosure will become apparent from the following detailed description, the accompanying drawings, and the appended claims.

DETAILED DESCRIPTION OF THE PREFERRED EMBODIMENT(S) OF THE DISCLOSURE

The present disclosure is generally related to an apparatus having cutter elements for destroying articles such as paper sheets, a paper stack separation mechanism for penetrating and separating at least one sheet to be shredded from a stack of paper on a tray, and a paper feed mechanism for advancing the at least one sheet separated by the paper stack separation mechanism into the cutter elements for shredding.

It should be noted that while this disclosure references separating sheet(s) of paper from a stack, the embodiments of the shredders described herein are also configured to separate, advance, and shred sheets of any size and/or other articles, such as, but not limited to, disks such as CDs or DVDs, credit cards, cardboard, etc. The shredder is designed to automatically separate a smaller portions from the stack (in which portions may contain sheet(s), paper stapled together, junk mails, CDs, credit cards, and a combination thereof) and feed them into the shredding mechanism. The stack can include numerous types, sizes, construction, and shapes of articles for shredding (e.g., white paper, letter size, A4, envelopes, etc.) and is not intended to be limited only to shredding paper sheets of any standard or non-standard size.

Figure 1:
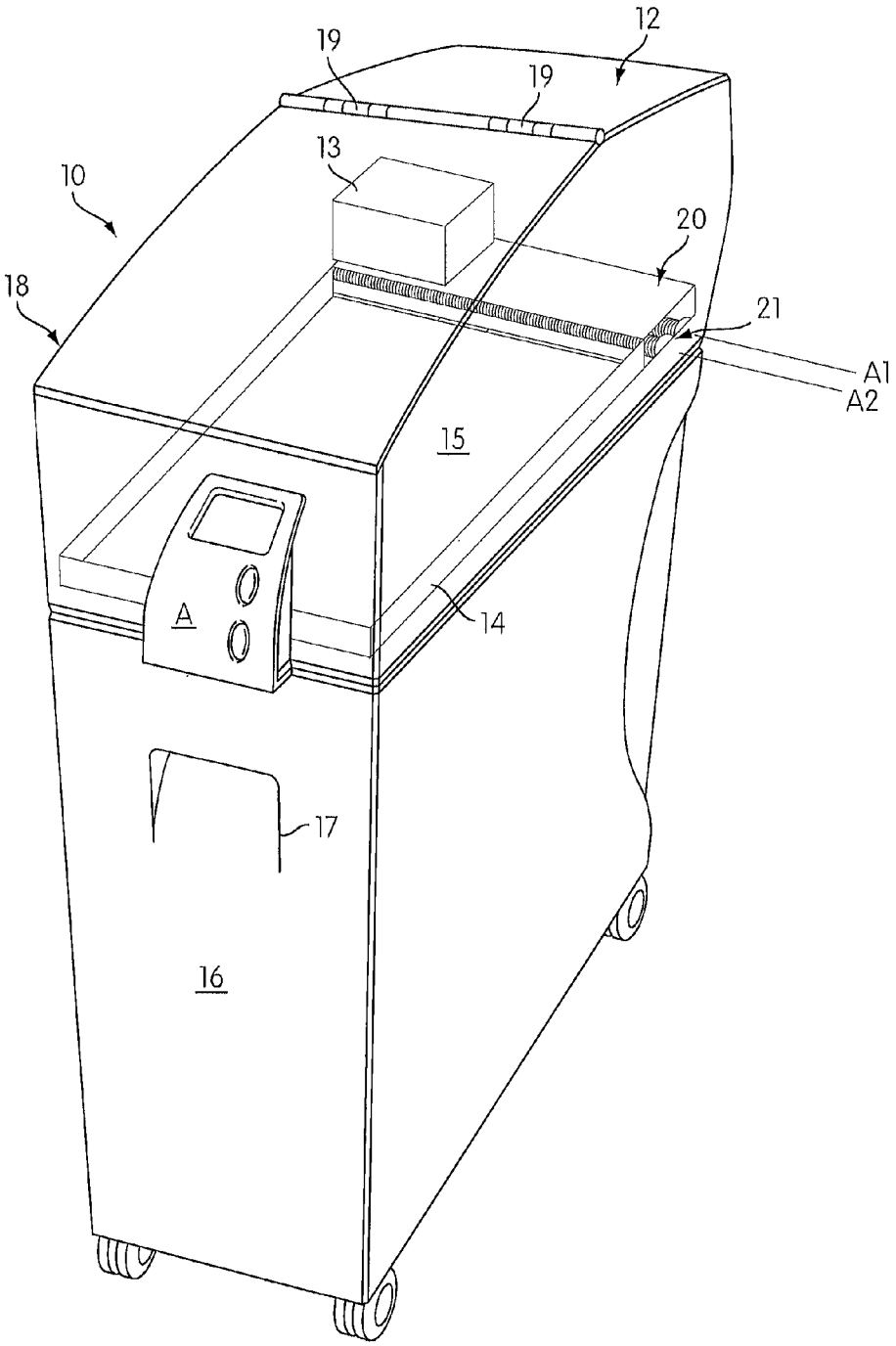
FIG. 1 is a perspective view of a shredder according to an embodiment of the present disclosure.

FIG. 1 is a perspective view of a shredder in accordance with an embodiment of the present invention. The shredder 10 is designed to destroy or shred articles such as paper. The shredder 10 comprises a housing 12 that sits on top of a container 16, for example. The container 16 receives paper that is shredded by the shredder 10. The container 16 may comprise a hole or opening 17 for a user to grasp. For example, the user may grab opening 17 to open or access the inside of the container 16, e.g., such as a separate waste bin held therein. The container 16 may itself be a waste bin, or may also be used to house a separate and removable waste bin, for example.

Generally speaking, the shredder 10 may have any suitable construction or configuration and the illustrated embodiment is not intended to be limiting in any way.

Figure 2:
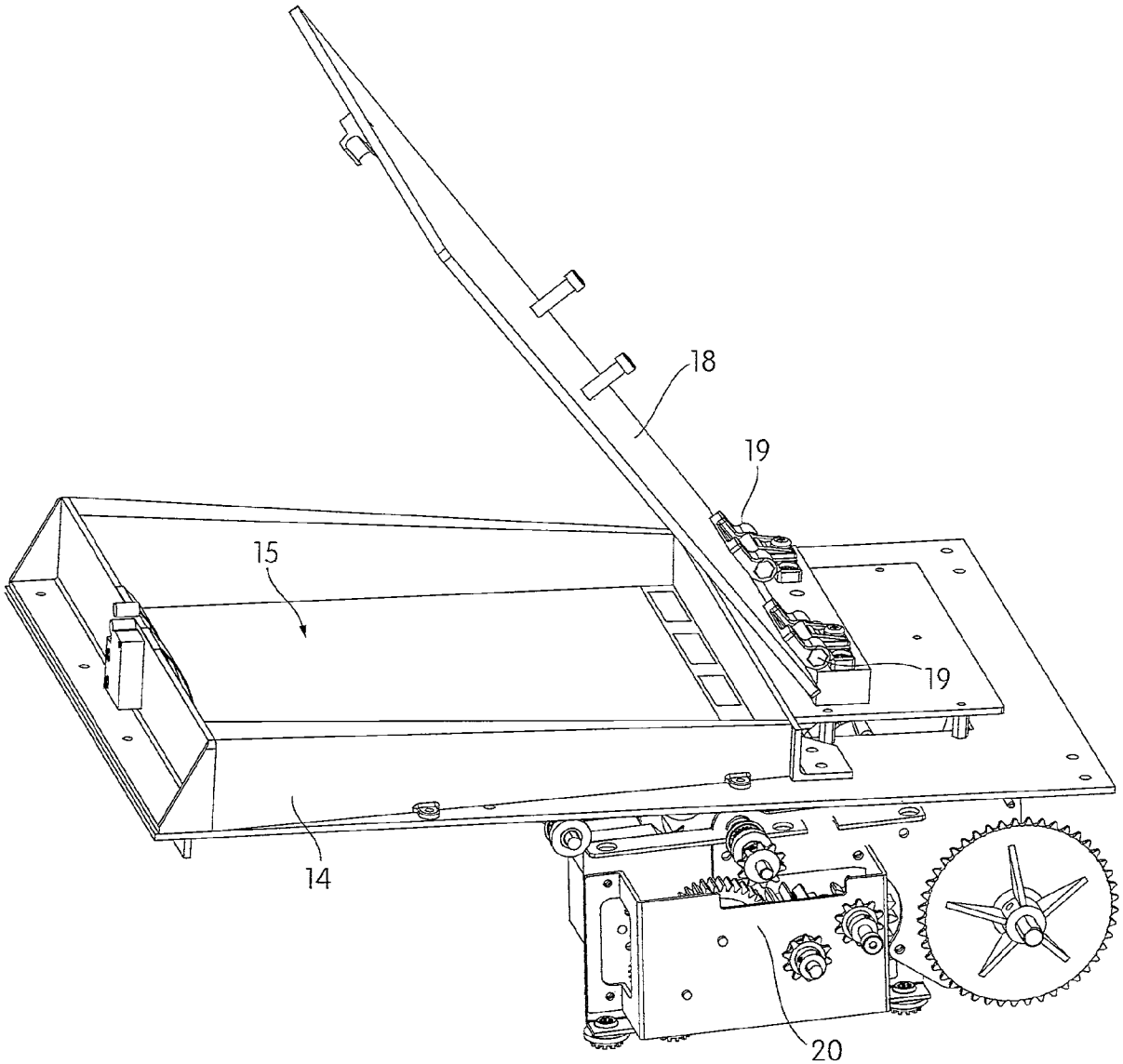
FIG. 2 is an alternate perspective view of a tray and shredder mechanism of the shredder of FIG. 1.

In an embodiment, the shredder 10 comprises a shredder mechanism 20 (sometimes referred to as a cutting block) in the housing 12. Alternatively, in another embodiment, the shredder mechanism 20 is provided in the container 16. In yet another embodiment, the shredder mechanism 20 extends into the housing 12 and into the container 16. The shredder mechanism 20 may be positioned adjacent to or below a source of paper (e.g., from a tray 14). FIGS. 1 and 2 illustrate exemplary embodiments of locations for a shredder mechanism 20 relative to the tray 14.

The shredder 10 also includes a drive system 13 with at least one motor, such as an electrically powered motor, and a plurality of cutter elements 21. The cutter elements 21 are mounted on a pair of parallel first and second mounting shafts 23 and 25, each configured to rotate about parallel axes A1 and A2. The parallel mounting shafts 23 and 25 can extend longitudinally in a horizontal direction, for example. The motor operates using electrical power to rotatably drive first and second rotatable shafts 23 and 25 of the shredder mechanism 20 and their corresponding cutter elements 21 through a conventional transmission so that the cutter elements 21 shred or destroy articles fed therein. The shredder mechanism may also include a sub-frame for mounting the shafts, motor, and transmission. The drive system 13 may have any number of motors and may include one or more transmissions. Also, the plurality of cutter elements 21 are mounted on the first and second rotatable shafts 23 and 25 in any suitable manner and are rotated in an interleaving relationship for shredding paper sheets fed therein. The operation and construction of such a shredder mechanism 20 is well known and need not be discussed herein in detail.

A throat 24 (e.g., see FIG. 8) or an exit outlet path and other parts may be provided in the housing 12 as well.

The housing 12 of shredder 10 is designed to sit atop a container 16, as noted above. The housing 12 works in cooperation with a cartridge or tray 14. Tray 14 comprises a feed bed 15 and is designed to hold a plurality or stack 22 of paper sheets that are to be shredded. The tray 14 is mounted such that the paper may be fed from bed 15 of the tray 14 and into the cutter elements 21 of the shredder mechanism 20. For example, the tray 14 and shredder mechanism 20 may be mounted horizontally such that the paper is fed into the shredder mechanism 20 and destroyed. In one embodiment, the tray 14 comprises angled or inclined portion in its bed 15. In another embodiment, the tray 5 is provided at an angle relative to shredder housing 12, such as via a sloped chassis. The tray 14 can have a bottom portion with an edge 48 adjacent to a paper stack separation mechanism, for example, configured to assist in directing at least one separated paper sheet in a direction towards the cutter elements 21 (see, e.g., features described with reference to FIGS. 7 and 11). In the illustrated embodiments disclosed herein, tray 14 has an inclined edge 48. However, the term "inclined" is not intended to be limiting in this or any of the embodiments disclosed herein.

In another embodiment, the tray 14 may comprise a sectioned or partitioned bin, providing limited access to an upper bin, for example, while documents in lower bin are fed to the shredder mechanism 20.

Figure 27:
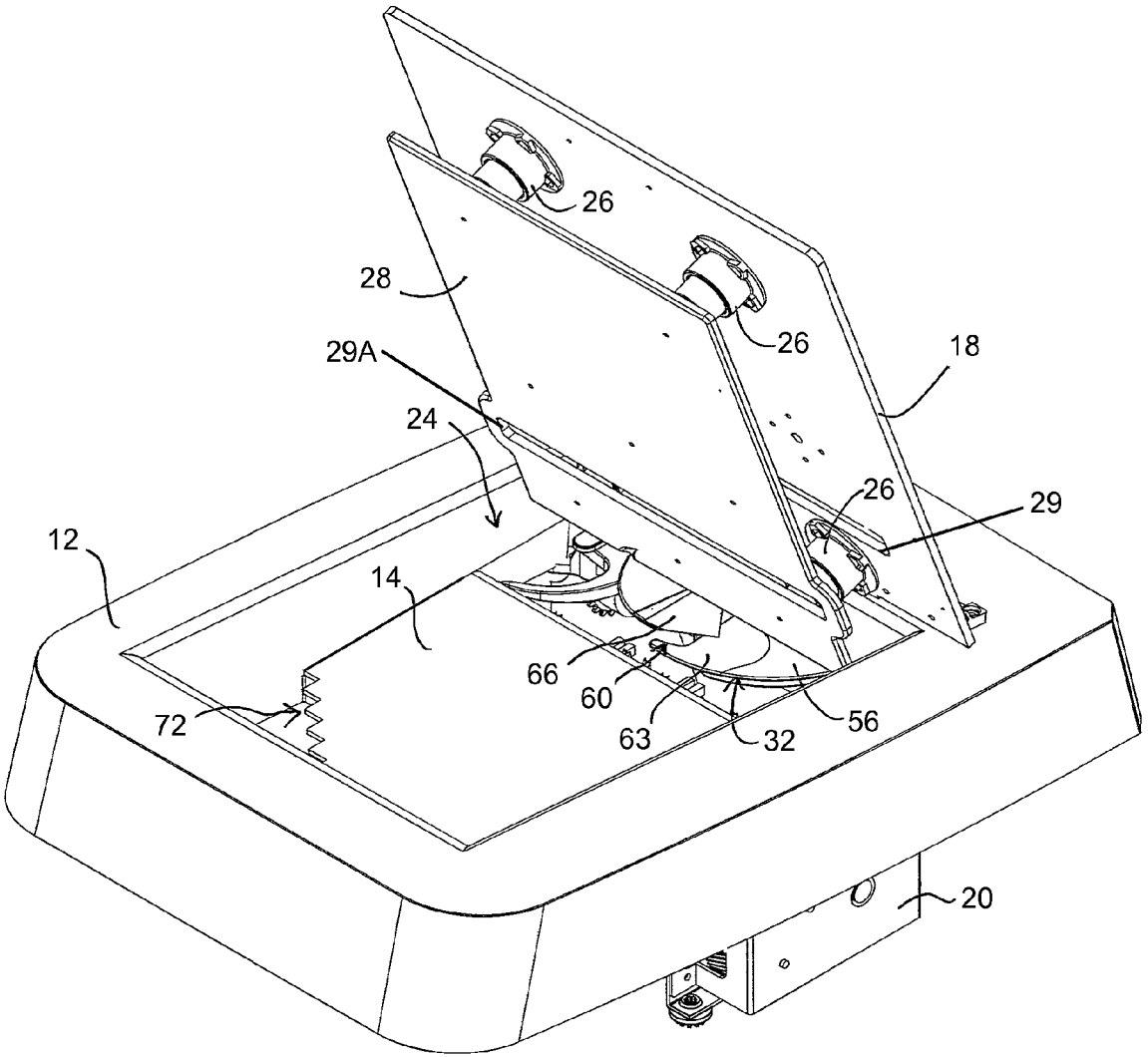
FIG. 27 shows a perspective view of a paper stack separation mechanism as similarly shown in FIGS. 14-26 with a lid and a pressure plate in a shredder housing according to another embodiment of the present disclosure.

In an embodiment, the housing 12 and/or tray 14 is provided with a lid 18. The lid 18 can be provided with one or more hinges 19 such that the lid 18 may be pivoted between open and closed positions, e.g., using a motor-driven transmission device (not shown), or by manual force, to allow user access to a tray 14 or feed bed 15, such as for filling the tray 14 with the paper to be shredded. Pivoting the lid 18 allows a user access to the inside of tray 14, such as for filling the tray 14 with paper to be shredded. In an embodiment, the tray 14 comprises a handle (not shown) to assist in lifting the lid 18. Any type or form of handle for assisting in lifting the lid 18 may be used and should not be limiting. FIG. 27, described later, shows another embodiment of a lid 18 with a pressure plate 28 attached thereto. In another embodiment, lid 18 and/or pressure plate 28 may comprise an opening or slot 29 and/or 29A (see FIG. 27) for allowing manual insertion of paper sheets into the tray 14 (e.g., when the lid is in a closed position) to bypass the devices.

In an embodiment, the lid 18 may comprise a safety switch and/or sensor(s). The safety switch and/or sensor(s) may be used to detect if the lid is pivoted to an open position. In an embodiment, when the lid 18 is lifted to an open position, parts of the shredder 10 are deactivated (e.g., such that paper may be inserted onto the tray without cause of injury). For example, the safety switch may be coupled to the shredder mechanism 20, drive system 13, and/or advancement (or feed) mechanism (described below) to prevent operation of the cutter elements 21 when the lid 18 is in the open position. The parts can be activated when the lid 18 is in the closed position to begin operation of the cutter elements 21 and an advancement (or feed) mechanism. The lid 18 may also comprise a locking mechanism that prevents a user from opening the lid or accessing the tray, which may not be desirable while the shredder is in use. In an embodiment, lid 18 may comprise an opening (not shown) for allowing insertion of paper sheets into the tray 14.

A control panel A can also optionally be provided on the housing 12 or other part of the shredder 10 for use therewith. As generally known by one of ordinary skill in the art, the control panel A can include a screen 54 and/or a plurality of buttons. The screen may be an LCD screen, for example, to show available menus or options to a user. Lights, LEDs, or other known devices (not shown) may also be provided on control panel A. Generally, the use of a control panel is known in the art and therefore not described in detail herein.

A power switch (e.g., on control panel A) may also be provided on the shredder 10. The power switch can include a manually engageable portion connected to a switch module (not shown). Movement of the manually engageable portion of switch moves the switch module between states. The switch module is communicated to a controller (not shown) which may include a circuit board. Typically, a power supply (not shown) is connected to the controller by a standard power cord with a plug on its end that plugs into a standard AC outlet. The controller is likewise communicated to the motor of the shredder mechanism 20. When the power switch is moved to an on position, the controller can send an electrical signal to the drive of the motor so that it rotates the cutting elements 21 of the shredder mechanism 20 in a shredding direction, thus enabling paper sheets to be fed therein. The power switch may also be moved to an off position, which causes the controller to stop operation of the motor. Further, the power switch may also have an idle or ready position, which communicates with the control panel A. The switch module contains appropriate contacts for signaling the position of the switch's manually engageable portion. Generally, the construction and operation of the power switch and controller for controlling the motor are well known and any construction for these may be used. Also, the switch need not have distinct positions corresponding to on/off/idle, and these conditions may be states selected in the controller by the operation of the switch.

In an embodiment, at least one sensor is provided in tray 14 for sensing the presence of paper sheets or a stack 22. The sensor(s) may be used to communicate with the controller that sheets are ready to be shredded or destroyed, or to communicate with the feed driver system. The presence of sheets may also start a timer. For example, a time delay may be activated such that a feed mechanism 23 begins to move or rotate after a set period of time (e.g., 30 minutes, 1 hour). The sensor(s) may be of any type, e.g., optical, electrical, mechanical, etc. and should not be limiting. Additionally, audio sensors may be used with tray 14. For example, a sensor(s) may be able to pick-up audio signals or sounds when paper is shredding or as paper is separated.

The shredder 10 also comprises a mechanism opposed to or adjacent the tray surface for advancing at least a sheet from a stack of paper in a tray towards the cutter elements for shredding. That is, shredder 10 is designed with a paper stack separation and advancement mechanism for automatically separating and advancing one or more sheets to a shredder mechanism 20 without requiring a user to manually feed individual or a preset quantity of sheets into the cutting elements 21.

Figure 3:
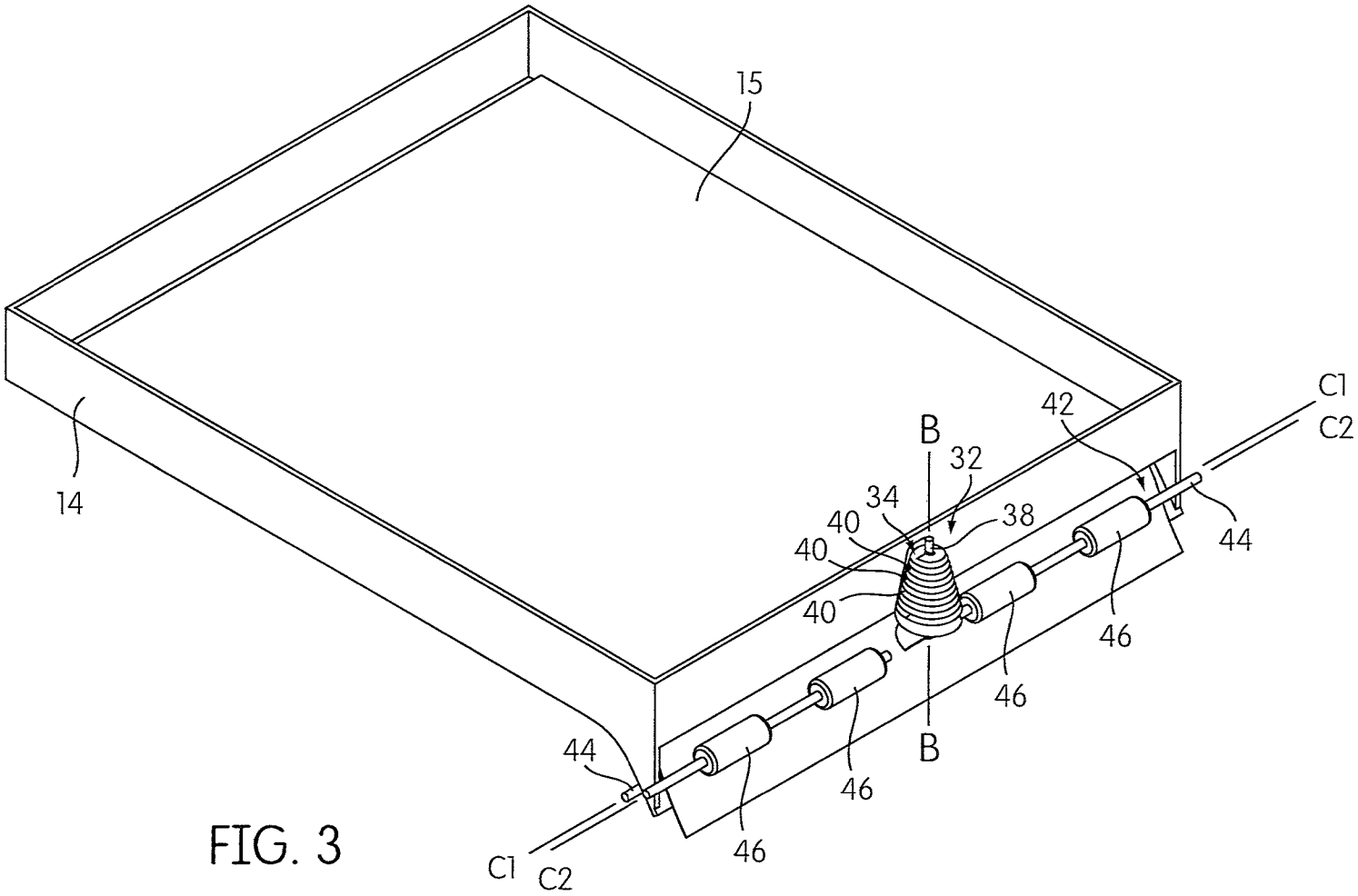
FIGS. 3 and 4 are a perspective view and an end view, respectively, of a tray and paper stack separation mechanism for use with the shredder of FIG. 1 in accordance with one embodiment.
Figure 4:
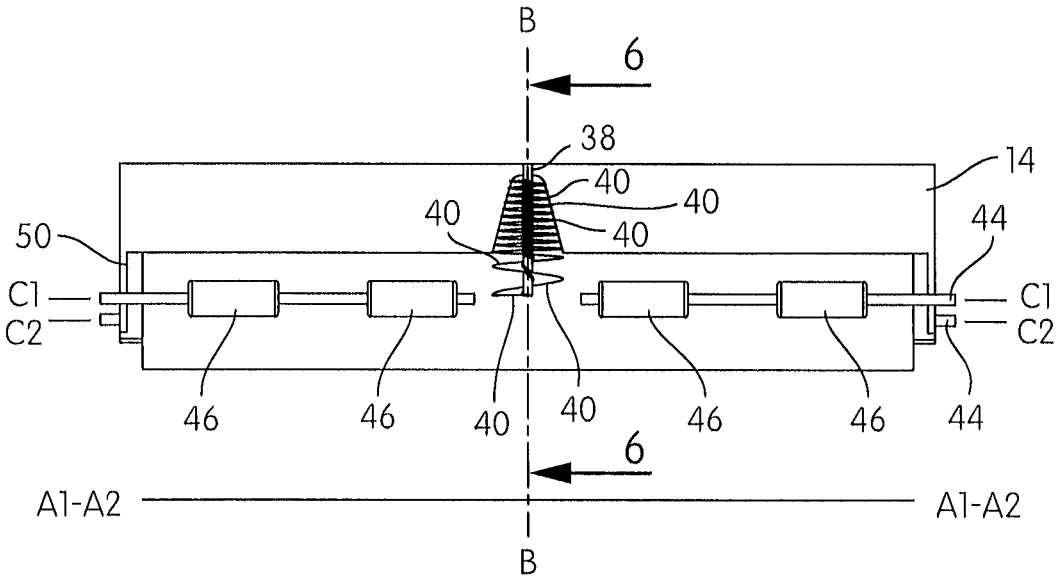
Figure 5:
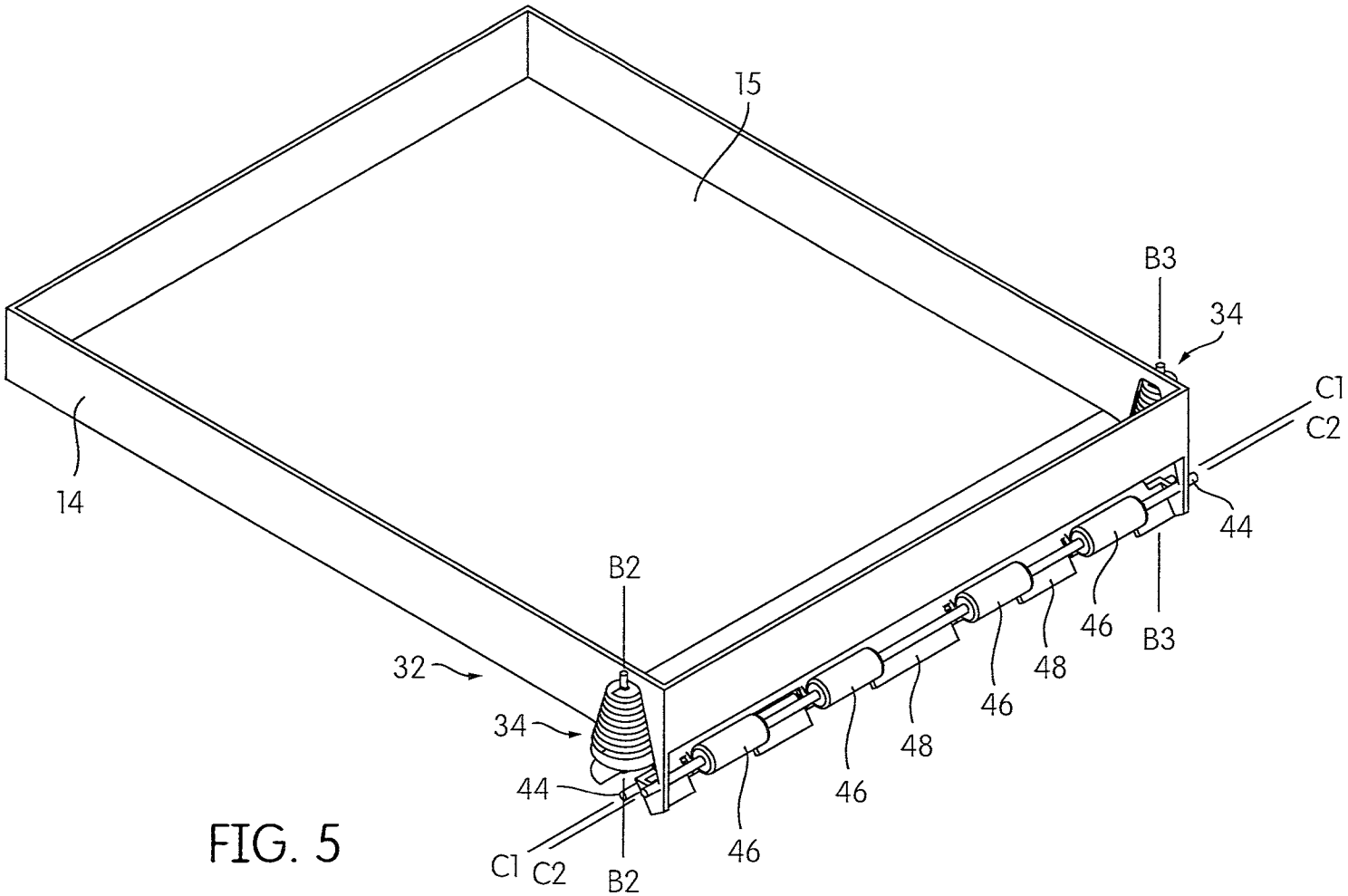
FIG. 5 is a perspective view of a tray and paper stack separation mechanism for use with the shredder of FIG. 1 in accordance with another embodiment.

FIGS. 3 and 4 show one embodiment of a tray and a paper stack separation and advancement mechanism 32 positioned adjacent to the tray 14. The tray 14 is positioned substantially horizontally relative to the shredder housing 12. The stack is positioned substantially horizontally within the tray 14, which is also positioned in a longitudinal direction. The mechanism 32 is rotatable for insertion into at least part of the stack 22 to separate at least an edge of at least one paper sheet therefrom for advancing the at least one separated paper sheet towards the cutter elements 21 (e.g., see FIG. 6). The paper stack separation and advancement mechanism 32 is positioned at or near a front edge (e.g., proximal to the shredder mechanism 20) of the tray 14. As shown in FIGS. 3 and 4, the paper stack separation and advancement mechanism 32 is positioned at or near a center line of the tray 14 in the lateral direction. The paper stack separation and advancement mechanism 32 may be positioned at least partially within the tray 14. In an embodiment, the paper stack separation and advancement mechanism 32 is positioned on at least one side of the tray 14, such as shown in FIG. 5 (described later below).

The paper stack separation and advancement mechanism 32 is configured for rotation about a rotational axis B-B that is substantially perpendicular to the axes A1 and A2 of the cutter elements 21. The mechanism 32 is mounted within the shredder housing 12 or, alternatively, within the shredder mechanism 20. The drive system 13 may be constructed to drive the paper stack separation and advancement mechanism 32 in an advancing direction (e.g., clockwise) to advance the at least one separated paper sheet from the stack and towards the cutter elements 21 of the shredder mechanism 20, for example.

Figure 7:
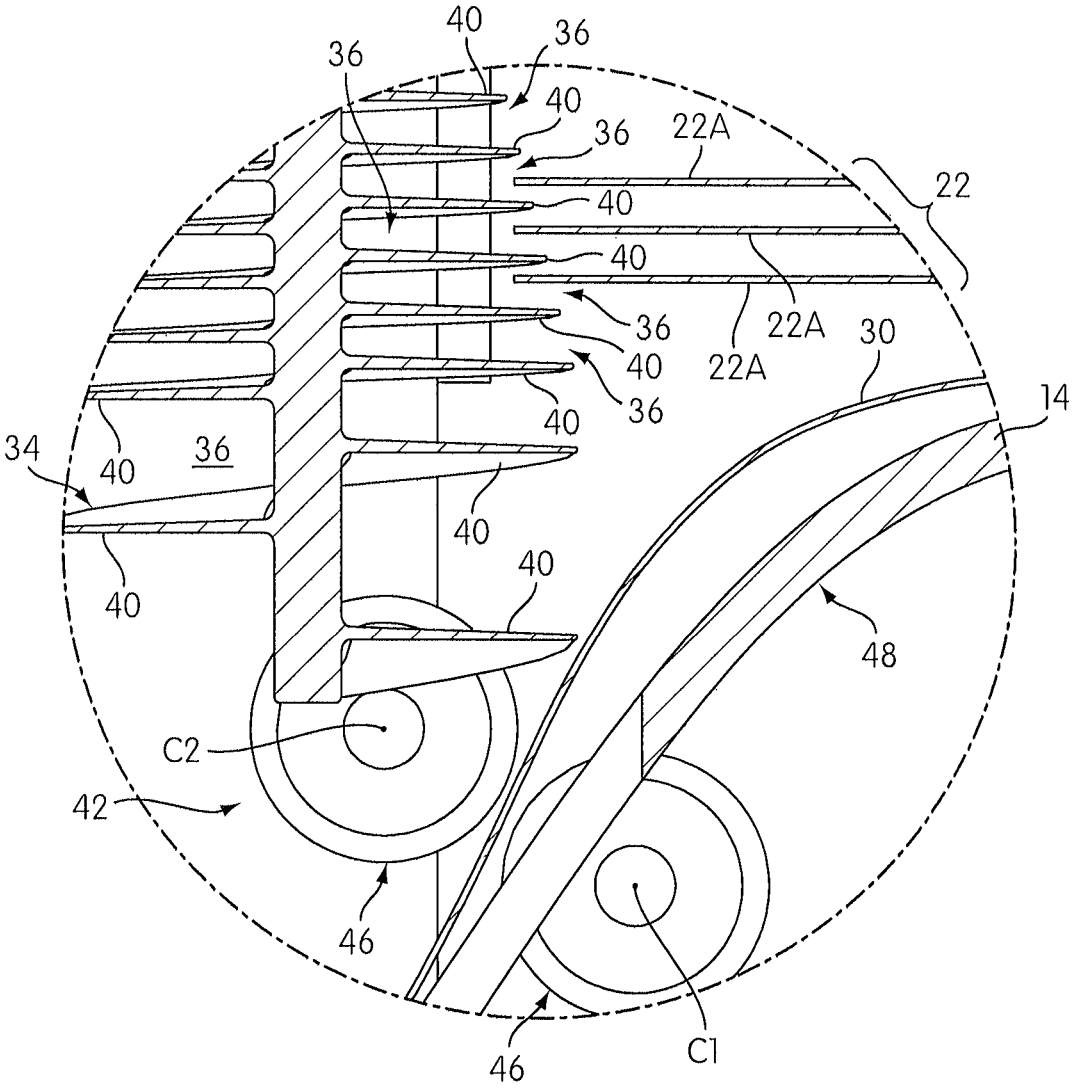
FIG. 7 is a detailed view of the paper stack separation mechanism and end of the tray.

As shown in Figures, the mechanism 32 includes at least one helical mechanism 34 configured for rotation about the rotational axis B-B. Each helical mechanism 34 can have spaces 36 (shown in detail in FIG. 7) configured for receipt of at least one separated paper sheet from the stack 22 within tray 14. As shown in FIG. 7, the at least one helical mechanism 34 also includes a shaft 38 configured for rotation about the rotational axis B-B and at least one radially extending structure 40 having turns positioned concentrically about the shaft 38 between its first and second (e.g., top and bottom) ends. The shaft 38 may be rotated in any direction, e.g., in a clockwise direction or a counterclockwise direction. In some embodiments, the shaft 38 is driven by the motor rotating the cutter elements 21 of the cutting assembly. In some embodiments, the shaft 38 is rotated by a separate motor (not shown). Generally, known links, gears, drive axles, and other devices may be used to connect the shaft 38 to the motor.

The radially extending structure 40 is configured to extend into the stack 22. Each turn of the radially extending structure 40 projects from a surface of shaft 38 in a substantially perpendicular direction in relation to its rotational axis B-B (i.e., in a radial direction), as shown in FIG. 7. Such a structure may be referred to as a finger or fin, for example. The described "structure" 40 as provided herein is defined as an elongated structure that generally extends or stands radially in relation to the shaft 38. The structure 40 is provided to assist in separating and bending or advancing paper from the tray 14 and towards cutter elements 21. The structure 40 is fixed in position on the shaft 38 so as to rotate with the shaft 38. Thus, when the shaft 38 is activated or rotated about axis B-B, the structure 40 rotates about axis B-B. As shown, the structure 40 can be associated with and/or formed with the shaft 38, and is not necessarily directly connected to the shaft 38.

In accordance with another embodiment, the radially extending structure 40 may be formed from a plurality of structures that extend from the shaft 38 between its first (top) end and its second (bottom) end. In on embodiment, the plurality of structures extends from the shaft 38 in a helical manner. For example, a plurality of fingers or fins may be spaced radially and helically around the shaft to form a spiral configuration around the shaft. In yet another embodiment, two or more radially extending structures, each comprising multiple turns, may be provided on the shaft 38.

The terms "radial" or "perpendicular" when used with respect to the radially extending structure 40 are not to be taken as requiring a perfect or true radial or perpendicular direction. Instead, having a perpendicular or radial extent or vector sufficient to project the structure from the shaft for performing their function is within the meanings of these terms. Likewise, the structure 40 need not be straight and may have curved or other shapes.

The spaces 36 are provided between each turns of the at least one radially extending structure 40, which are shown in greater detail in FIG. 7. The dimensions of and associated with the spaces 36 and radially extending structure 40, including their relation to and distribution along shaft 38, should not be limiting. The dimensions of the features themselves may vary. In one embodiment, the spaces 36 of the at least one helical mechanism 34 are substantially equal in width. In accordance with an embodiment, some, but not all, of the spaces 36 of the at least one helical mechanism 34 are substantially equal in width. In embodiments, the spaces vary in width along a length (e.g., between its first and second ends) or along at least part of the length (e.g., from a center of the shaft to an end) of the at least one helical mechanism 34.

Figure 6:
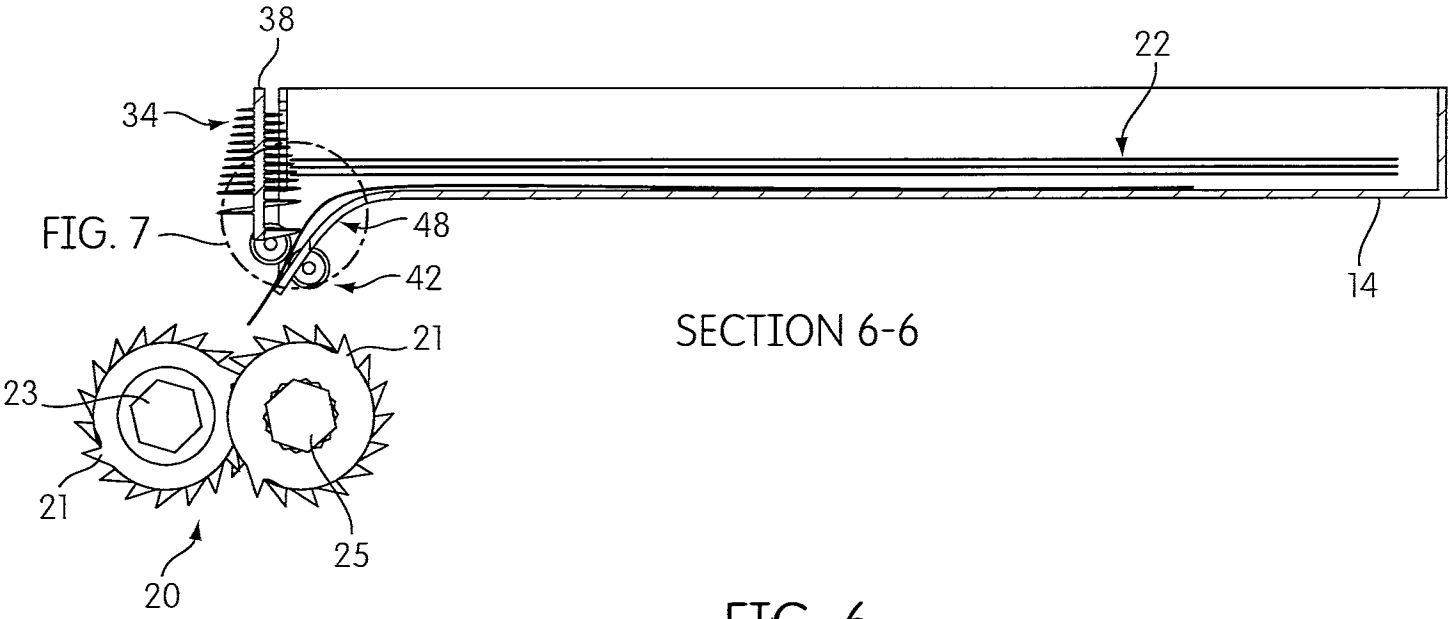
FIG. 6 is a sectional view of the tray of FIG. 4 along line 6-6.

In the illustrated embodiment shown in FIG. 7, the at least one radially extending structure 40 is provided around the shaft 38 in a substantially conical configuration between its top and bottom ends. As shown in FIG. 6, a length (measured from a point joined with the shaft 38 to its distal end) of each extending turn (or fin) of the radially extending structure 40 increases from a first (top) end (e.g., spaced distally from the shredder mechanism 20) of shaft 38 towards a second (bottom) end (e.g., spaced proximally to the shredder mechanism 20) thereof. Also, as shown in FIG. 7, the widths of the spaces 36 between each turn of the structure 40 gradually increases from about a center of the shaft 38 towards the second (bottom) of the shaft 38 (i.e., in the direction towards the cutter elements 21). Such features, however, are not meant to be limiting.

The varying and/or increase in the width of the spaces in a direction towards the cutter elements 21 of the shredder mechanism 20 aids in separating and fanning out the separated sheet(s) 30 from the stack 22 in the tray 14. Accordingly, this enables a systematic and/or timed release of the separated sheet(s) 30 for easier feeding and/or grabbing (e.g., by rollers of a paper feed mechanism, described below) for feeding into the cutter elements 21. Moreover, the radially extending structure 40 can assist in bending and directing the separated sheet(s) 30 towards the cutter elements 21 (e.g., see FIG. 7).

In operation, the paper stack separation and advancement mechanism 32 shown in FIGS. 3-7 is configured to separate at least a bottom sheet 30 from the stack 22 in the tray 14 for feeding to the shredder mechanism. As shown in detail in FIG. 7, as the helical mechanism 34 rotates about its axis B-B, sheets 22A from at least a bottom of the stack 22 are separated and received in spaces 36 between the turns of the radially extending structure 40. The helical configuration bends and directs the separated edge of paper downward towards the cutter elements 21 of the shredder mechanism 20. The drive arrangement not only advances sheet(s) by bending edge(s) of the stack, but also allows separated paper to be grasped and advance freely into the cutters.

To assist in the advancement of the separated sheet(s), as shown in FIG. 6, the tray 14 includes a bottom portion comprising an inclined edge 48 and opening 50 adjacent to the paper stack separation and advancement mechanism 32 (e.g., at a front, proximal end near the shredder mechanism). The inclined edge 48 of the tray 14 is configured to assist in directing the at least one separated paper sheet towards the cutter elements 21 through opening 50. As shown in detail in FIG. 7, as the helical mechanism 34 continues to rotate, a bottom sheet 30 is directed downwardly towards shredder mechanism 20 by bending and guiding the bottom sheet 30 along inclined edge 48 using the at least one radially extending structure 40.

To further aid in feeding separated paper 30 to the shredder mechanism 20, a paper feed mechanism 42 may be provided in shredder 10. As shown in FIG. 6, for example, the paper feed mechanism 42 is positioned adjacent to the inclined edge 48 of the tray 14 for advancing the at least one separated paper sheet 30 into the cutter elements 21. The paper feed mechanism 42 includes one or more rollers 46 mounted on parallel shafts 44 configured to rotate about parallel axes C1 and C2 (see FIGS. 3 and 4). In accordance with one embodiment, the axes C1 and C2 of paper feed mechanism 42 are configured to be substantially parallel to the axes A1 and A2 of the cutter elements 21, shown in FIG. 6. The drive system 13 may be constructed to drive the paper feed mechanism 42 in an advancing direction (e.g., clockwise) to advance the at least one separated paper sheet 30 separated from the stack 22 by paper stack separation and advancement mechanism 32 and towards the cutter elements 21 of the shredder mechanism 20, for example. The one or more rollers 46 extend or are positioned longitudinally along the shafts 42 along a width of the tray 14, adjacent to the inclined edge 48. The one or more rollers 46 on the shafts 42 are configured to grasp an edge of the at least one separated paper sheet 30 therebetween to bend and further advance the sheet 30 towards the cutter elements 21.

The inclined edge 48 of tray 14 may be a singular structure that extends the width of the tray 14, or multiple structures spaced relative to the rollers 46 of paper feed mechanism 42, along a front end of the tray 14. For example, as shown in FIGS. 5 and 7, rollers 46 on shaft 44 that rotate about axis C1-C1 may be configured to align with rollers 46 on shaft 44 that rotate about axis C2-C2 to form one or more pairs along the width of the tray 14, while the structural edges of inclined edge 48 are provided to extend at an incline between such roller pairs. In an alternate embodiment, rollers 46 may be configured to extend at least partially through openings within inclined edge 48.

FIG. 5 shows an alternate embodiment of a paper stack separation and advancement mechanism 32 comprising two helical mechanisms 34 positioned at or near side edges of the tray 14. Further, the mechanisms 34 are positioned at or near a front edge (e.g., proximal to the shredder mechanism 20) of the tray 14. The helical mechanisms 34 are configured for rotation about each of their rotational axes B2-B2 and B3-B3 and each have at least one radially extending structure 40 extending perpendicularly from their shafts 38. The radially extending structure 40 of each helical mechanism 34 may be positioned at least partially within the tray 14 to separate sheets of paper in the stack 22. The embodiment shown in FIG. 5 is operated in a substantially similar manner as noted above, and can be used with the paper feed mechanism 42, as shown. However, it is not meant to be limiting. For example, the positioning of the helical mechanisms 34 within the tray 14 may be altered without departing from the scope of this disclosure. In accordance with an embodiment, one helical mechanism may be positioned at or near a side edge of the tray at a front end or corner of the tray, while another helical mechanism is positioned at or near side edge of the tray, closer to a center of the side edge. As such, one of ordinary skill in the art can understand the changes in positioning of the helical mechanism(s) while still accomplishing the described separation and advancement features.

The materials used to form helical mechanism 34 including radially extending structure 40 and shaft 38 are not limited and any number or combination of materials may be used. In an embodiment, the radially extending structure 40 is formed from a substantially flexible or resilient material. In another embodiment, the radially extending structure is formed from a substantially rigid material. Rollers 46 may be formed from a substantially flexible or resilient material, such as rubber.

The rate at which the at least one radially extending structure 40 is rotated using shaft 38 should not be limiting. The rate may be set, predetermined, or variable. It is envisioned that, in an embodiment, the rate at which the shaft 38 of helical mechanism 34 is rotating may be adjusted during shredding. For example, it is envisioned that the rate of rotation may be based on the articles or materials being shredded, such as paper versus discs. In another embodiment, the rate which the shaft 38 of helical mechanism 34 is rotated may be adjusted based on a detected thickness of article(s).

The rotation of helical mechanism 34 about axis B-B may be activated in any number of ways. In some embodiments, the rotation may be activated manually. For example, a switch may be provided which triggers a motor to start rotation of the helical mechanism 34. In some embodiments, the rotation of the helical mechanism 34 may be activated automatically. In this case, "automatically" activating rotation refers turning or rotating the shaft 38 of the helical mechanism 34 at the time or detection of a predetermined event or occurrence. For example, the rotation may be associated with the activation of the shredder mechanism 20. The helical mechanism 34 may also be activated to rotate concurrently with the cutter elements 21 (e.g., such as when the motor is used or activated to rotate the shredder mechanism 20). In some embodiments, the rotation of the helical mechanism 34 is associated with a power switch for turning on the shredder 10.

Similarly, the rate at which the rollers 46 are rotated using shafts 44 should not be limiting. The rate may be set, predetermined, or variable. It is envisioned that, in an embodiment, the rate at which the shafts 44 is rotating may be adjusted during shredding. For example, it is envisioned that the rate of rotation may be based on the articles or materials being shredded, such as paper versus discs. In another embodiment, the rate which the shafts 44 of paper feed mechanism 42 are rotated may be adjusted based on a detected thickness of article(s).

The rotation of the paper feed mechanism 42 about axes C1-C1 and C2-C2 may be activated in any number of ways. In some embodiments, the rotation may be activated manually. For example, a switch may be provided which triggers a motor to start rotation of the feed mechanism 42. In some embodiments, the rotation of the paper feed mechanism 42 may be activated automatically. In this case, "automatically" activating rotation refers turning or rotating the shafts 44 of the feed mechanism 42 at the time or detection of a predetermined event or occurrence. For example, the rotation may be associated with the activation of the shredder mechanism 20. The paper feed mechanism 42 may also be activated to rotate concurrently with the cutter elements 21 (e.g., such as when the motor is used or activated to rotate the shredder mechanism 20). In some embodiments, the rotation of the feed mechanism 42 is associated with a power switch for turning on the shredder 10.

In some embodiments, the rotation of the helical mechanism 34 and/or feed mechanism 42 may be associated with one or more sensing devices of the shredder 10, such as sensors within the tray 14 used to determine if the tray is full. The sensor(s) may be provided on the bottom portion or side of the tray 14 or in the bed 15.

Figure 8:
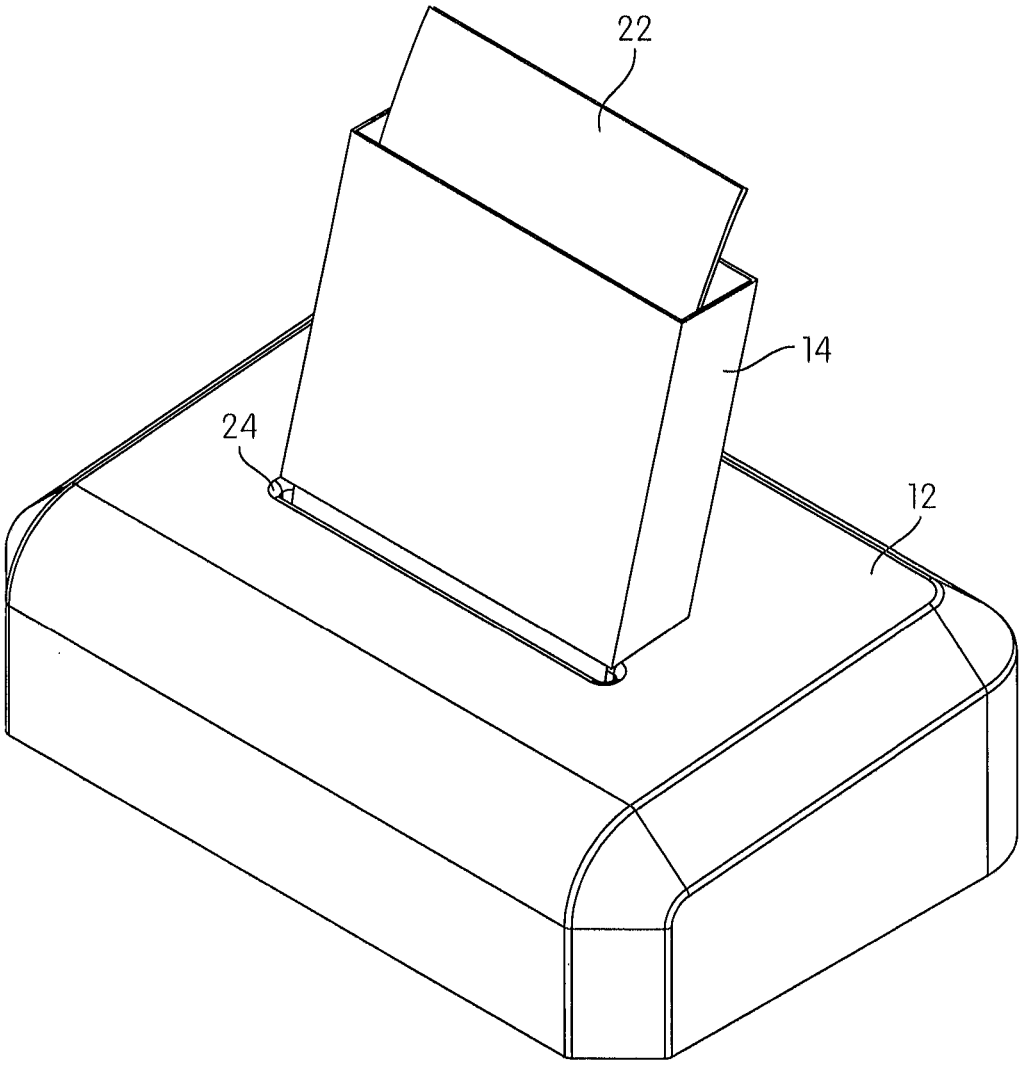
FIGS. 8 and 9 are a perspective view and an end view, respectively, of a tray and shredder housing for use with a shredder in accordance with another embodiment.
Figure 9:
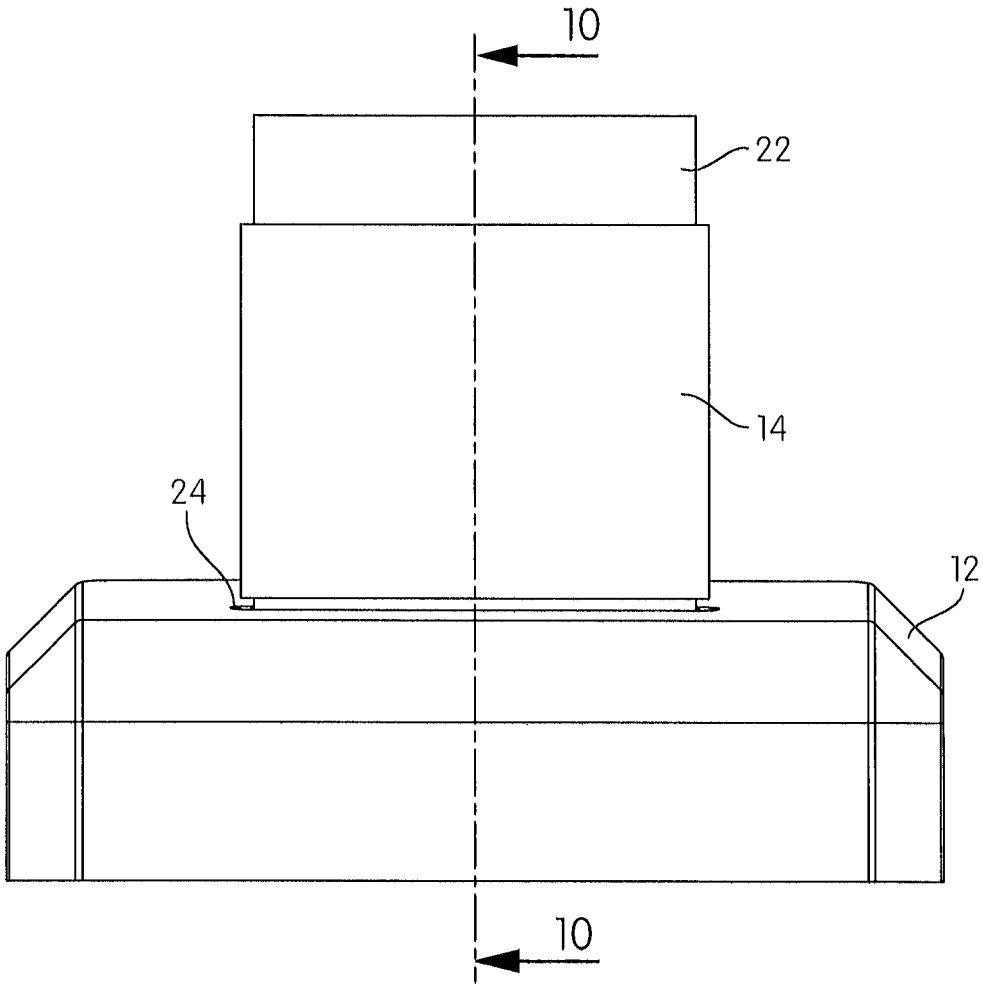
Figure 10:
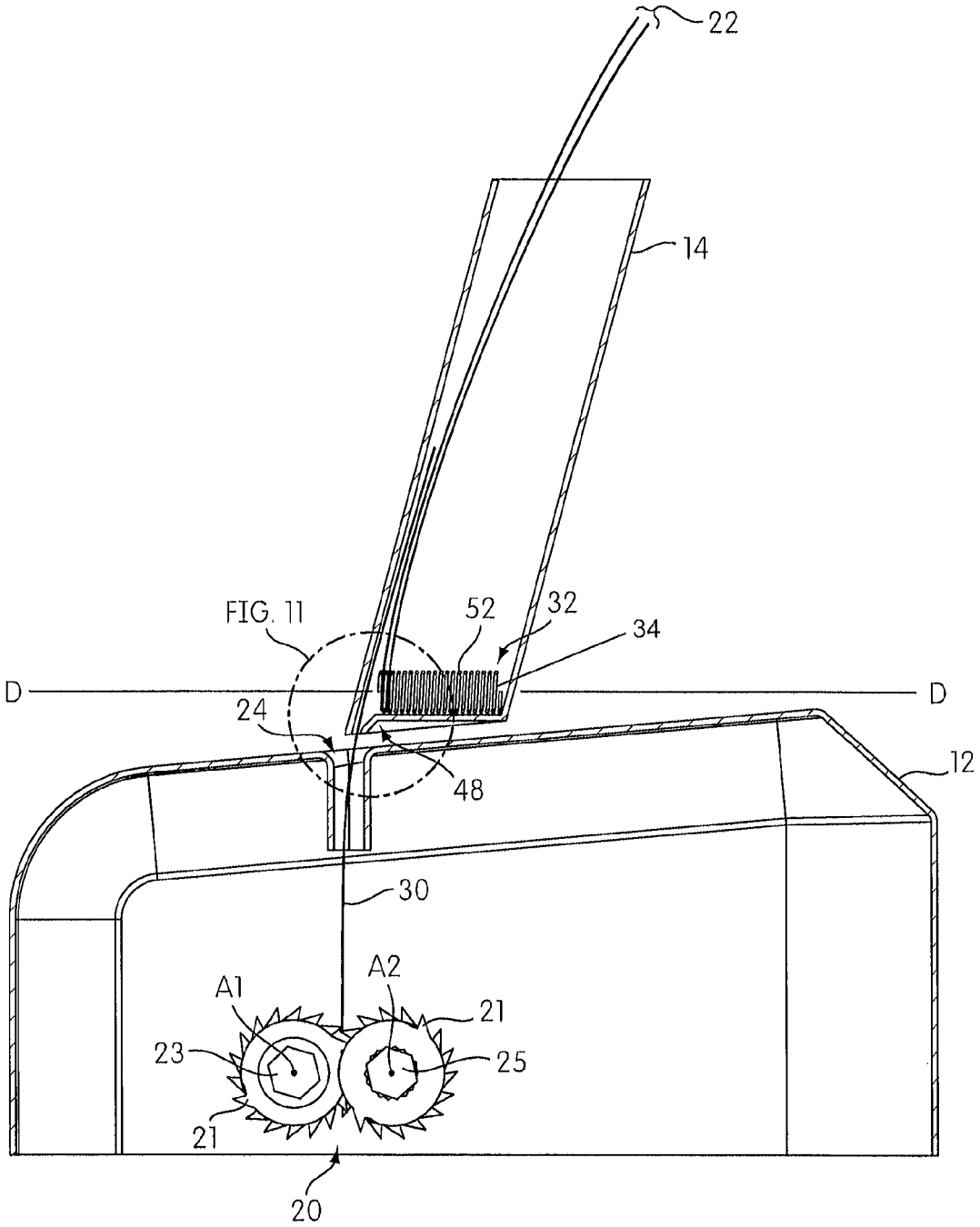
FIG. 10 is a sectional view of the tray and shredder housing of FIG. 9 along line 10-10.

FIGS. 8-13 illustrate another embodiment of a shredder housing 12 and a tray 14 including a paper stack separation and advancement mechanism 32 positioned within tray 14. Specifically, as shown in FIGS. 8 and 9, the tray 14 is positioned substantially vertically relative to the shredder housing 12, thus positioning the stack 22 substantially vertically within the tray 14. The tray 14 is configured to direct separated sheet(s) into the throat 24 of the housing 12. The paper stack separation and advancement mechanism 32 includes at least one helical mechanism 34 configured for rotation about a rotational axis D-D that is substantially perpendicular to the axes A1 and A2 of the cutter elements 21. The at least one helical mechanism 34 in this illustrated embodiment includes at least one coil 52, which is shown in greater detail in FIG. 13. As shown by the sectional view in FIG. 10, the at least one coil 52 of the paper stack separation and advancement mechanism 32 is positioned within the tray 14, at or near its center in the lateral direction and adjacent its bottom portion or end (e.g., an end adjacent shredder housing 12). However, in an embodiment, the at least one coil 52 is positioned on at least one side of the tray 14.

The at least one coil 52 includes two or more loops in series having spaces 36 therebetween that are configured for receipt of at least one separated paper sheet from the stack 22. As defined by this disclosure, the at least one coil 52 includes a continuous series of loops or turns (e.g., two or more) with alternate spaces therebetween that are positioned and wound concentrically with respect to a central axis. The loops of each coil 52 act in a similar manner to the previously described radially extending structure(s) in that they are configured to assist in separating and advancing paper from the tray 14 and towards cutter elements 21. The separated paper can be moved from a back end of the tray to the front end of the tray (adjacent the throat 24), for example. A front end 54 of the at least one coil 52 is configured to release separated paper approximately every 360 degrees as the coil 52 is rotated about its axis. The spaces 36 (shown in detail in FIG. 11) are configured for receipt of at least one separated paper sheet from the stack 22 within tray 14. The loops can have substantially similar spaces 36 therebetween, as shown. Alternatively, the spacing 36 between each ring of the coil(s) can vary. For example, the spaces 36 between each loop or turn of the coil 52 may vary in width.

The loops and spaces of the coil aid in separating and fanning out the separated sheet(s) 30 from the stack 22 in the tray 14. The size of the loops and/or spacing therebetween enables a systematic and/or timed release of the separated sheet(s) 30 into the cutter elements 21.

Although not shown, the coil(s) may be connected to a shaft configured for rotation about the rotational axis D-D and driven by a motor (e.g., a motor rotating the cutter elements 21 of the cutting assembly).

In operation, the paper stack separation and advancement mechanism 32 shown in FIGS. 8-13 is configured to separate at least a top or front sheet 30 from the stack 22 in the tray 14 for feeding to the shredder mechanism. As shown in detail in FIG. 11, as the helical mechanism 34 rotates about its axis D-D, sheets 22A from at least a top or a front of the stack 22 are separated and received in spaces 36 between the connected rings of the coil 52. As the front end 54 of the at least coil 52 is rotated, e.g., clockwise, it will pass below a bottom edge of the separated (front) paper 30 thereby releasing the separated paper 30 from the tray 14 and into throat 24, towards the cutter elements 21 of the shredder mechanism 20. The coil 52 separates and directs the separated edge of paper downward towards the cutter elements of the shredder mechanism. The coil drive arrangement not only advances sheet(s) by separating paper edge(s) of the stack, but also allows separated paper to advance freely into the cutters (e.g., via gravity).

Figure 11:
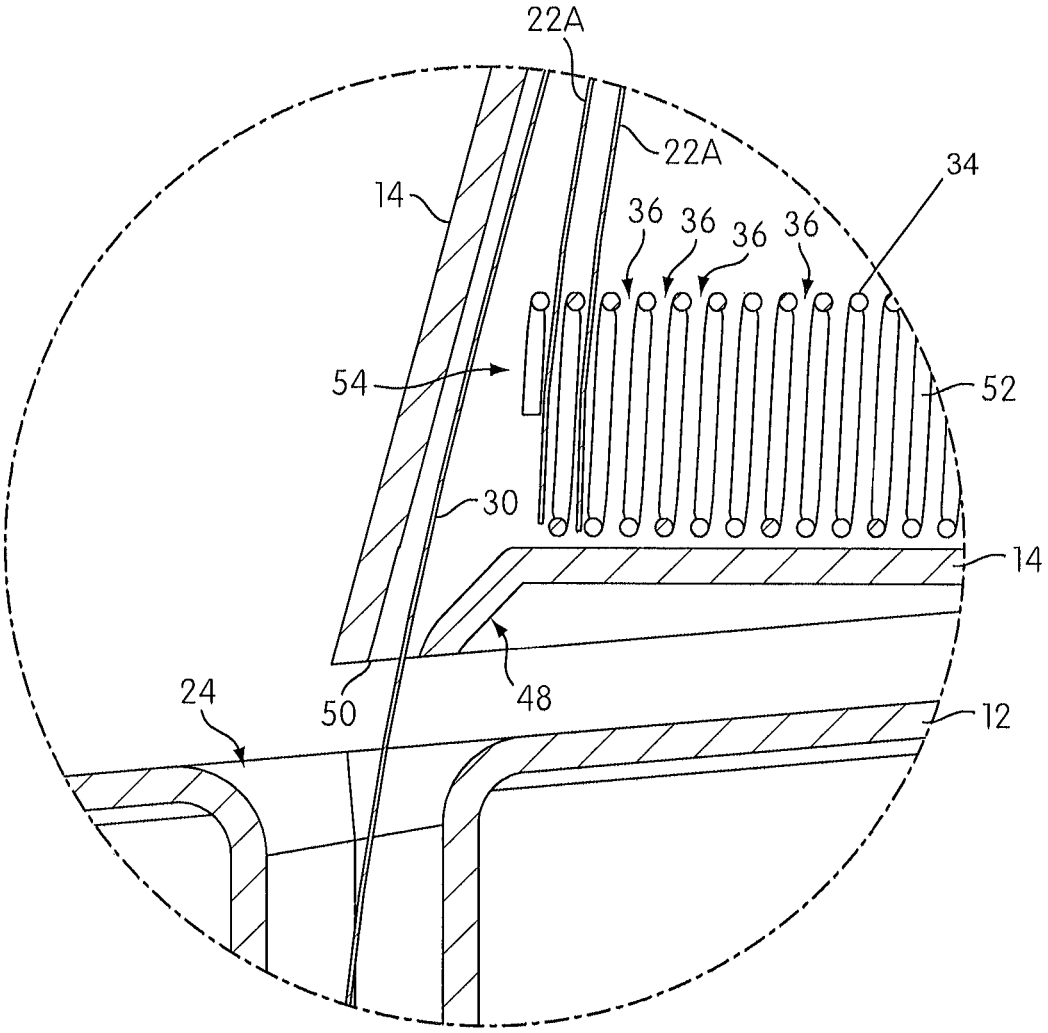
FIG. 11 is a detailed view of the paper stack separation mechanism and end of the tray of FIG. 10.
Figure 12:
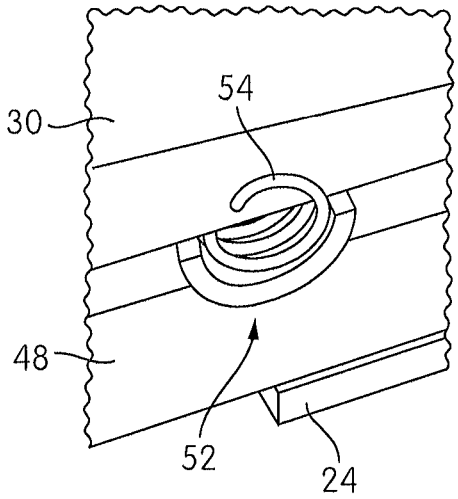
FIG. 12 is a detailed, end view of the paper stack separation mechanism.
Figure 13:
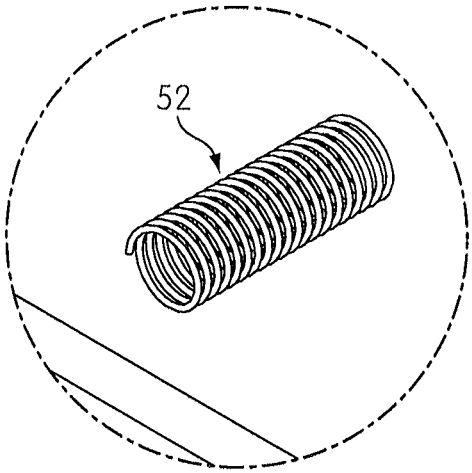
FIG. 13 is a perspective view of a coil for use in the paper stack separation mechanism.

To assist in the advancement of the separated sheet(s), as shown in FIG. 11, the bottom portion of tray 14 has the inclined edge 48 and opening 50 therein. The separated top or front sheet(s) 30 from stack 22 are configured for guidance by inclined edge 48 to fall from tray 14 through opening 50 in its bottom portion via gravity towards and into the shredder mechanism 20, after the front end 54 of coil 52 passes the bottom edge of the sheet(s) 30.

A paper feed mechanism 42, such as described above, can but need not be provided with the shredder configured to use the paper stack separation and advancement mechanism 32 of FIGS. 8-13.

The materials used to form helical mechanism 34 are not limited and any number or combination of materials may be used. The rate at which the at least one coil 52 is rotated should not be limiting. The rate may be set, predetermined, or variable. It is envisioned that, in an embodiment, the rate at which the coil is rotating may be adjusted during shredding. For example, it is envisioned that the rate of rotation may be based on the articles or materials being shredded, such as paper versus discs. In another embodiment, the rate which the coil(s) of helical mechanism 34 is rotated may be adjusted based on a detected thickness of article(s).

The rotation of helical mechanism 34 about axis D-D may be activated in any number of ways. In some embodiments, the rotation may be activated manually. In some embodiments, the rotation of the helical mechanism 34 may be activated automatically. In this case, "automatically" activating rotation refers turning or rotating the coil(s) of the helical mechanism 34 at the time or detection of a predetermined event or occurrence. For example, the rotation may be associated with the activation of the shredder mechanism 20. The helical mechanism 34 may also be activated to rotate concurrently with the cutter elements 21 (e.g., such as when the motor is used or activated to rotate the shredder mechanism 20). In some embodiments, the rotation of the helical mechanism 34 is associated with a power switch for turning on the shredder 10.

In some embodiments, the rotation of the helical mechanism 34 may be associated with one or more sensing devices of the shredder 10. The sensor(s) may be provided on the bottom portion or side of the tray 14.

Figure 14:
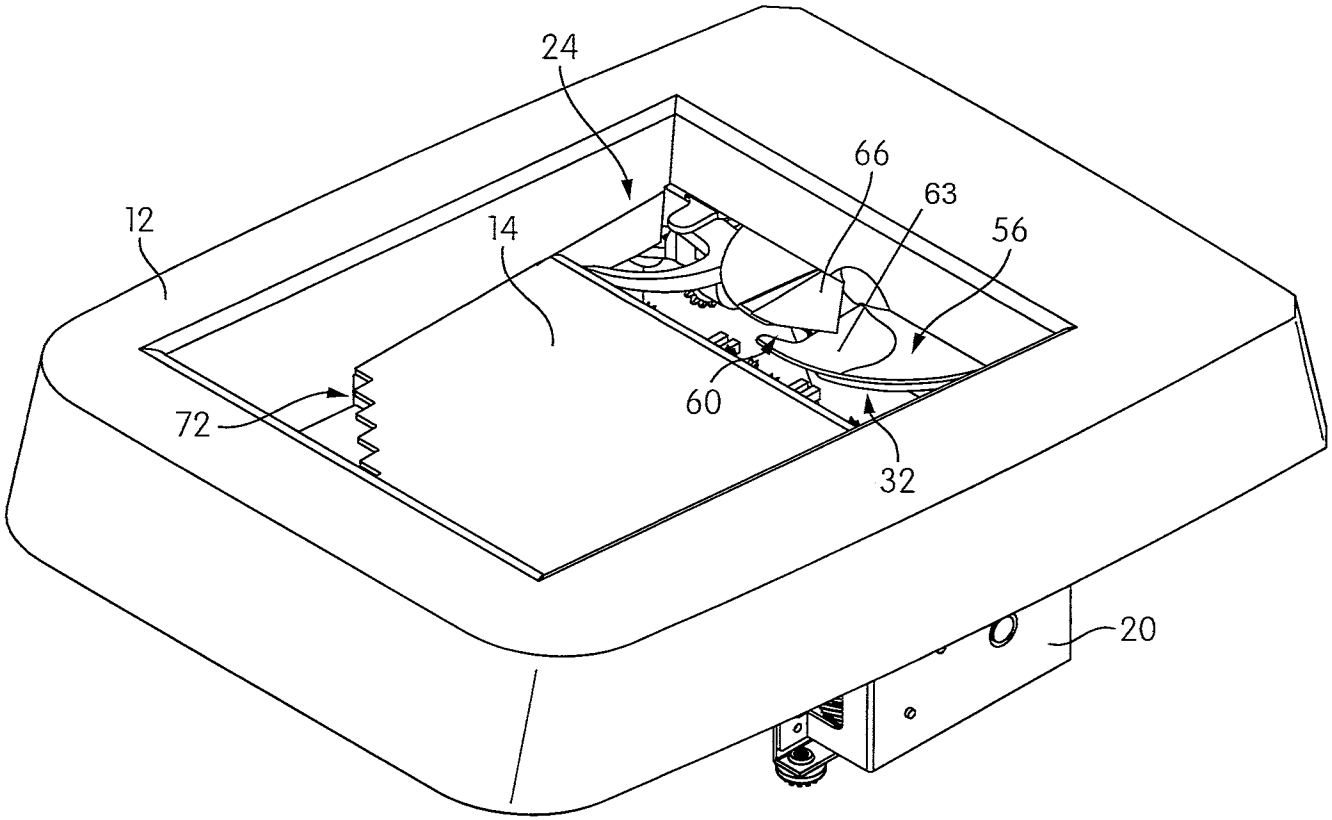
FIGS. 14 and 15 are a perspective view and a top view, respectively, of a shredder housing, a tray, rear staple pickers, and a paper stack separation mechanism for use with a shredder in accordance with yet another embodiment.
Figure 15:
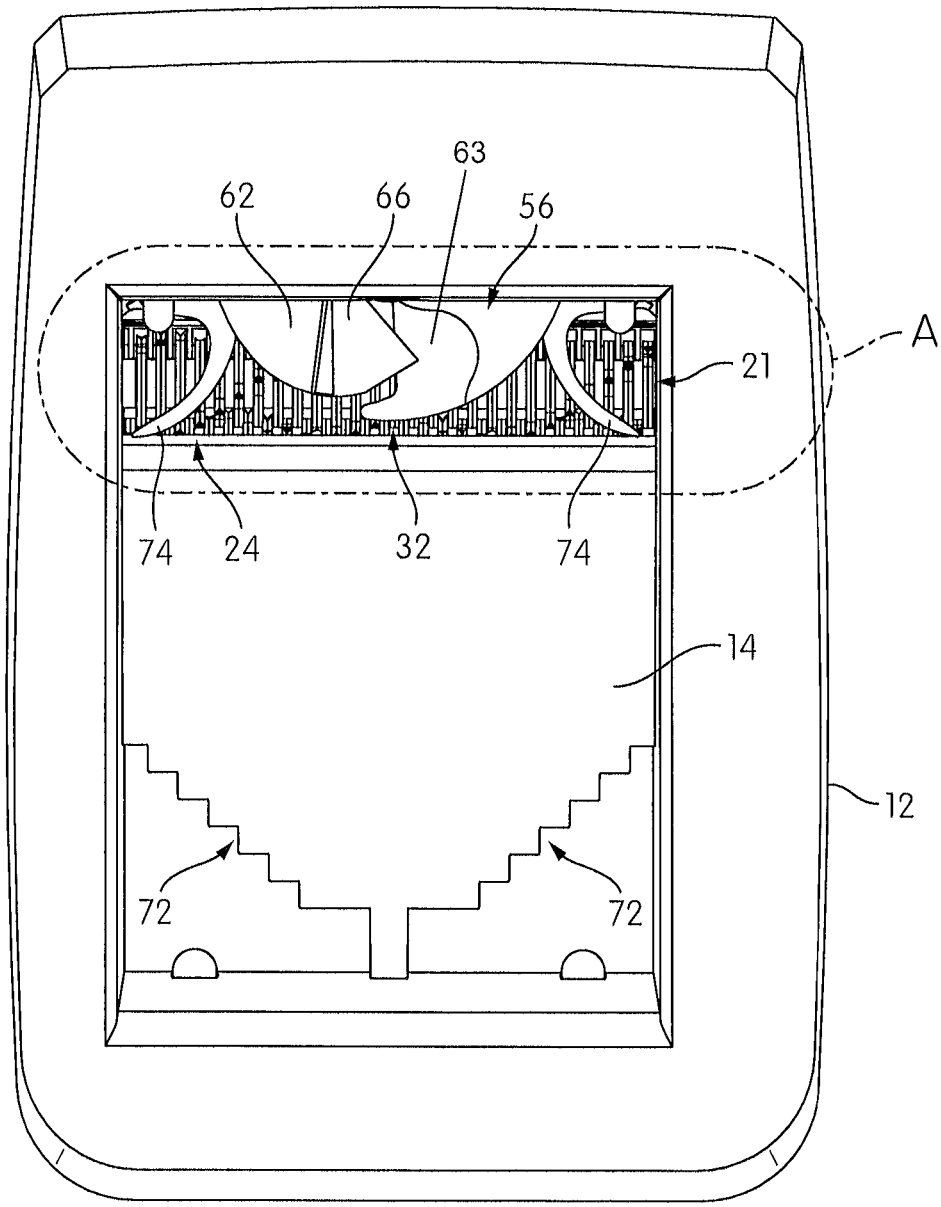
Figure 16:
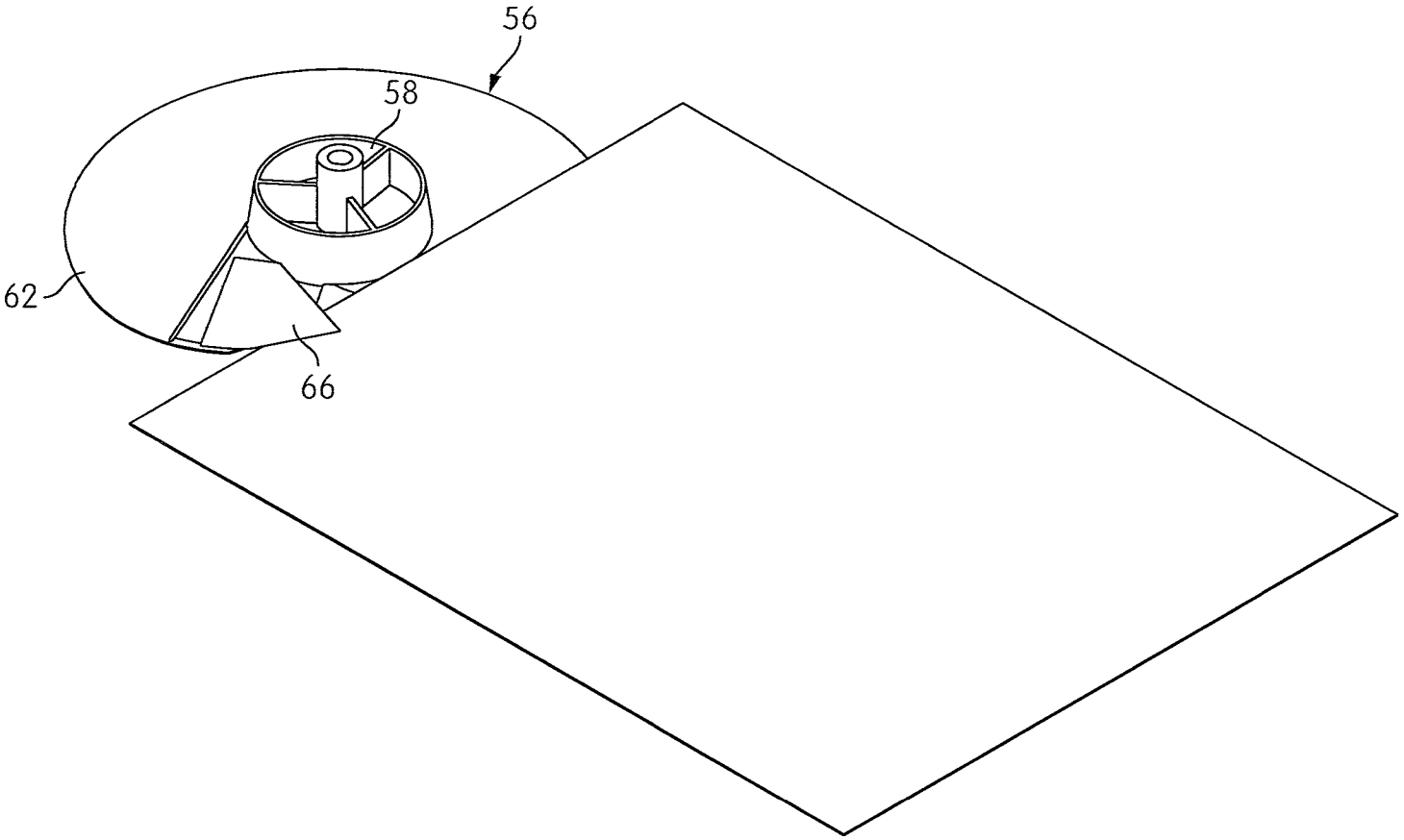
FIG. 16 is a perspective view of the paper stack separation mechanism of FIGS. 14 and 15 in position for separating a page.
Figure 17:
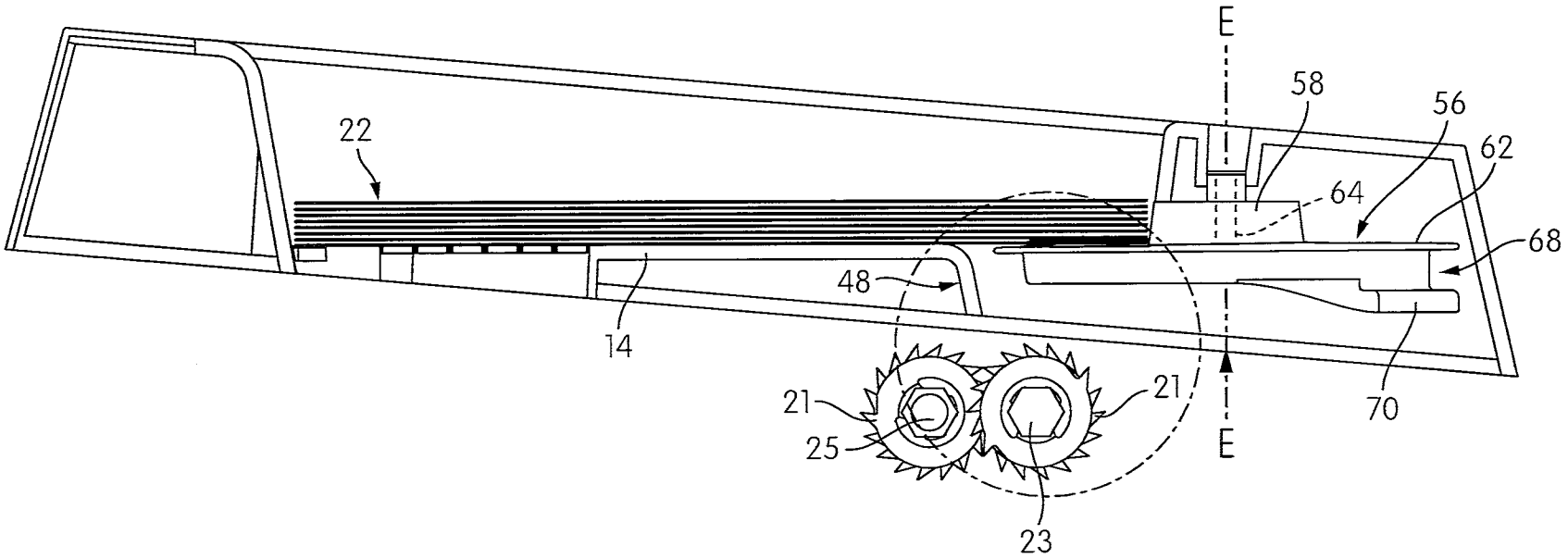
FIG. 17 shows a sectional side view of the shredder housing, tray, and paper stack separation mechanism of FIGS. 14 and 15.
Figure 18:
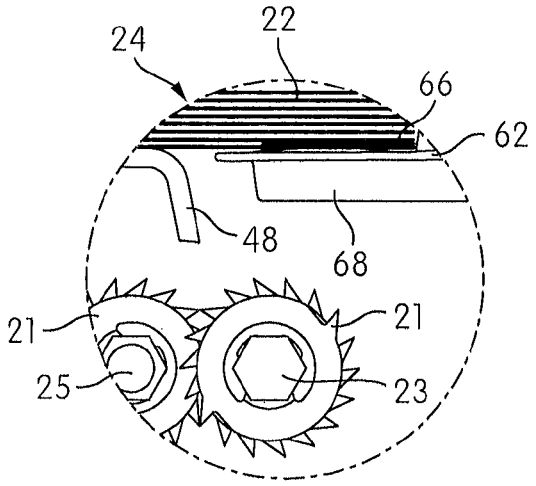
FIGS. 18-21 show detailed views of the rotation of paper stack separation mechanism and movement of a separated page using the devices of FIGS. 14 and 15.

FIGS. 14 and 15 show yet another embodiment of a shredder housing 12, a tray 14, and a paper stack separation and advancement mechanism 32 positioned adjacent to the tray 14. The tray 14 is shown positioned substantially horizontally relative to the shredder housing 12. In accordance with another embodiment, the tray 14 can be provided at an angle relative to the paper stack separation and advancement mechanism, as shown in FIG. 17, for example, to advance loose sheet(s) in the tray towards the mechanism 32. The stack is positioned substantially horizontally within the tray 14, which is also positioned in a longitudinal direction. The mechanism 32 is rotatable for insertion into at least part of the stack on tray 14 to separate at least an edge of at least one paper sheet therefrom for advancing the at least one separated paper sheet towards the cutter elements 21 (e.g., see FIG. 16). The paper stack separation and advancement mechanism 32 is positioned at or near a front edge (e.g., proximal to the shredder mechanism 20) of the tray 14. As shown in FIGS. 3 and 4, the paper stack separation and advancement mechanism 32 is positioned at or near a center line of the tray 14 in the lateral direction. The paper stack separation and advancement mechanism 32 may be positioned at least partially within the tray 14.

As shown in FIG. 17, for example, the paper stack separation mechanism is configured for rotation about a rotational axis E-E that is substantially perpendicular to the axes (A1 and A2, not shown) of the cutter elements 21. The paper stack separation mechanism is mounted within the shredder housing 12 adjacent to the shredder mechanism 20. The drive system 13 (see FIG. 1) may be constructed to drive the paper stack separation mechanism of FIGS. 14-26 in an advancing direction (e.g., counter-clockwise) to advance the at least one separated paper sheet from the stack and towards the cutter elements 21 of the shredder mechanism 20, for example.

As shown in Figures, the paper stack separation and advancement mechanism 32 (see FIG. 14) includes a helical mechanism 56 configured for rotation about the rotational axis E-E. Helical mechanism 56 includes a body 58 that has a helical structure 62 with a separation blade 66 attached thereto. The body 58 of helical mechanism 56 connects with a shaft 64 (e.g. see FIGS. 17 and 22) that is configured for rotation about the rotational axis E-E. The helical structure 62 has an edge with the separation blade 66 extending in a spaced relationship to a surface 63 on its top portion. The blade 66 is configured to extend into the stack 22 to separate one or more sheets from the stack in the tray 14, as shown in FIG. 16. The blade 66 projects from structure 62 of body 58 in relation to its rotational axis E-E. The blade 66 is fixed in position relative to body 58 so as to rotate with the body 58. Thus, when the body 58 is activated or rotated about axis E-E, the blade 66 rotates with helical structure 62 about axis E-E.

As shown in FIG. 16, the blade 66 is designed to extend into the stack and place at least one sheet between its lower surface and surface 63 (not shown) of the helical mechanism 56. As previously mentioned, there is a space 60 between the blade 66 and the surface 63 so that separated sheet(s) can be guided by the helical mechanism. In one embodiment, the space 60 between the blade 66 and the surface 63 of the structure 62 is based on a thickness of sheets or articles that is designed to be separated from the bottom of the stack within the tray 14. The dimensions (e.g., height or angle) of the space 60 can determine the number of sheet(s) to be separated and picked from the stack. The size of the space 60 between the blade 66 and the surface 63 can be altered based on the desired number of sheets for separating. The dimensions of and associated with space 60 should not be limiting and may vary.

In the illustrated embodiment, as viewed in FIG. 15, the body of helical mechanism 56 is configured to rotate in a counter-clockwise direction so that the blade 66 can pick at least one sheet from the bottom of a stack on the tray 14. That is, the position of the blade 66 as shown in the drawings, e.g., such that its pointed separation edge is facing the right as shown in FIG. 15, determines the direction of rotation about rotational axis E-E. In another embodiment, the pointed separation edge of the blade 66 can face an opposite direction (e.g., left, such as by turning the body 58 upside-down before mounting on the shaft 64). Accordingly, the direction of rotation can be dependent upon a mounting position and direction of the blade 66.

As shown in FIG. 17, body 58 also includes a lower structure 68 that radially extends from body 58, relative to shaft 64. The lower structure 68 is designed to guide and bend separate sheet(s) in a downward direction towards the cutter elements. The lower structure 68 is a helical structure that turns with the body 58. The lower structure 68 includes an inclined body with a guide edge 70 on a bottom portion thereof. This is so that paper that is separated from the stack is guided further downwardly towards the shredder mechanism 20 after being separated from the stack, as shown in FIGS. 18-21. Specifically, the guide edge 70 is designed to move the separated edge of the sheet(s) into the interleaved cutting elements 21 as the body 58 is rotated.

Figure 19:
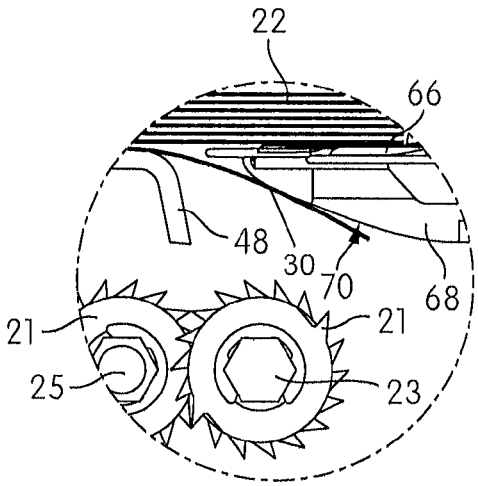
Figure 20:
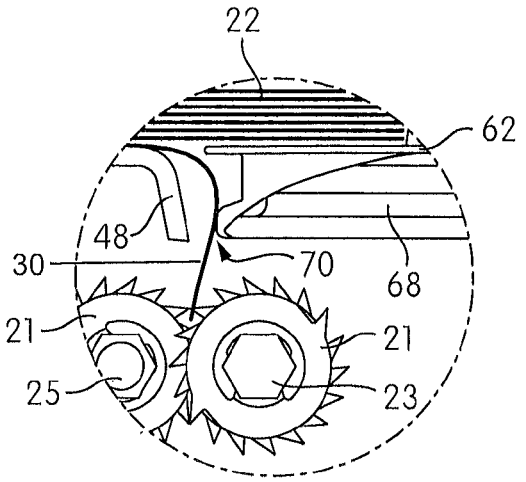

For example, FIGS. 18-21 show detailed views of the rotation of paper stack separation mechanism with helical structure 62 and movement of a separated page using the device 56 of FIGS. 14 and 15. The stack 22 is positioned on the tray 14 and ends of the sheets can be positioned adjacent (or over) the throat 24 and adjacent (or over) the top surface of the helical structure 62. In operation, the separation blade 66 is configured to rotate with the helical structure 62 for insertion into the stack 22 to separate at least a bottom sheet 30 from the stack 22 in the tray 14 for feeding to the shredder mechanism. As shown in detail in FIG. 19, as the helical mechanism 62 rotates about its axis E-E, sheet 30 is separated and guided by the inclined body during the turn of the lower structure 68. As the helical structure 62 continues to turn, the guide edge 70 pushes and bends the separated edge of the sheet 30 and then directs the separated edge of paper downward towards the cutter elements 21 of the shredder mechanism 20, as shown in FIG. 20. As previously noted in the described alternate embodiments, to assist in the advancement of the separated sheet(s), the tray 14 can include a bottom portion with an inclined edge 48 adjacent to the paper stack separation mechanism (e.g., at a front, proximal end near the shredder mechanism). The inclined edge 48 of the tray 14 is configured to assist in directing the at least one separated paper sheet into the throat and towards the cutter elements 21. As shown in detail in FIG. 21, as the helical mechanism 62 continues to rotate, a bottom sheet 30 is directed downwardly towards shredder mechanism 20 by bending and guiding the bottom sheet 30 along inclined edge 48 using the lower structure 68. The end of the sheet 30 is pulled into and between the cutter elements 21 as the guide edge 70 is further rotated with the lower structure 68. The arrangement not only advances sheet(s) by bending edge(s) of the stack, but also allows separated paper to be grasped and advance freely into the cutters.

As previously described, the inclined edge 48 of tray 14 may be a singular structure that extends the width of the tray 14, or multiple structures spaced relative to the body 58 of helical mechanism 56 adjacent a front end of the tray 14.

Figure 21:
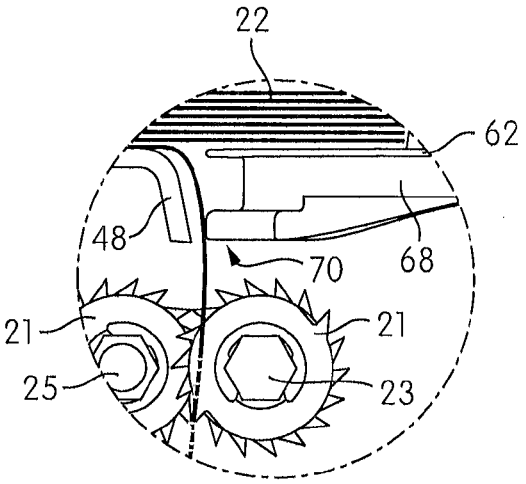

In one embodiment, a space can also be provided between the top portion of the helical structure 62 and the guide edge 70 on lower portion 68, as shown in greater detail in FIG. 17 as well as FIG. 21. The space is designed to accommodate movement of a stripper device of the staple picking support mechanism, e.g., hooks 74 (described further below) as the body 58 is rotated. Accordingly, this enables a systematic and/or timed movement of the helical mechanism 62 and the hooks 74 for easier feeding and/or guiding of separated sheet(s) into the cutter elements 21. The dimensions of and associated with the space should not be limiting and may vary. Such features are not meant to be limiting.

Also, as previously noted, it should be noted that the tray 14 can be provided at an angle, as shown in FIG. 17. Specifically, the tray 14 is shown at an angle such that a front end of the paper or articles therein and the throat 24 are positioned slightly higher than a back end. The surface of helical mechanism 56 can be positioned slightly higher than tray bed 14, as shown, to ensure the accuracy of the helical mechanism 56 (e.g., for picking and advancing paper from the stack 22). Separated paper can more accurately register on the top surface of the helical structure 62.

The rotation of helical mechanism 56 about axis E-E may be activated in any number of ways. In some embodiments, the rotation may be activated manually. In some embodiments, the rotation of the helical mechanism 56 may be activated automatically. In this case, "automatically" activating rotation refers turning or rotating body 58 of the helical mechanism 56 at the time or detection of a predetermined event or occurrence. For example, the rotation may be associated with the activation of the shredder mechanism 20. The helical mechanism 56 may also be activated to rotate concurrently with the cutter elements 21 (e.g., such as when the motor is used or activated to rotate the shredder mechanism 20). In some embodiments, the rotation of the helical mechanism 56 is associated with a power switch for turning on the shredder 10. In some embodiments, the body 58 is driven by the motor rotating the cutter elements 21 of the cutting assembly, i.e., by rotating shaft 64. In some embodiments, the body 58 and its shaft 64 are rotated by a separate motor (not shown). Generally, known links, gears, drive axles, and other devices may be used to connect the shaft 64 to the motor. For example, referring to FIGS. 22 and 24, which shows the relative positioning of the helical mechanism 56 and the cutter elements 21, it can be understood that gears and similar mechanisms can be mounted in the housing 12 in order to connect the devices for cooperation in order to rotate the shafts 23 and 25 and shafts 64.

In some embodiments, the rotation of the helical mechanism 56 is associated with a power switch for turning on the shredder 10. In some embodiments, the rotation of the helical mechanism 56 may be associated with one or more sensing devices of the shredder 10, such as sensors within the tray 14 used to determine if the tray is full. The sensor(s) may be provided on the bottom portion or side of the tray 14 or in the bed 15.

The materials used to form helical mechanism 56 including body 58, structure 62, and blade 66 are not limited and any number or combination of materials may be used. In an embodiment, the blade is formed from a spring steel material. In another embodiment, the blade is formed from a substantially rigid material. The thickness of the blade can vary, e.g., the edge configured to pick the paper can be thinner or sharper as compared to the end connected to the body. The body and structure can be formed from a molded plastic material, for example.

The rate at which the body 58 is rotated should not be limiting. The rate may be set, predetermined, or variable. It is envisioned that, in an embodiment, the rate at which the helical mechanism 56 is rotating may be adjusted during shredding. For example, it is envisioned that the rate of rotation may be based on the articles or materials being shredded, such as paper versus discs. In another embodiment, the rate which the body 58 of helical mechanism 56 is rotated may be adjusted based on a detected thickness of article(s).

As noted, the shredder 10 may also comprise one or more staple picking support mechanisms for stripping paper sheets from staples. Some examples are shown in FIGS. 14-15 and FIGS. 22-26. Although shown in associated with the embodiment of helical mechanism 56, it should be understood that one or both of the devices illustrated in FIGS. 14-15 and 22-26 can be optionally associated with a shredder having any of the helical mechanisms shown in the embodiments of FIGS. 3-13. The staple picking support mechanism is provided in the form of stripper devices 72 and/or 74 which are devices for removing or stripping the at least one separated paper sheet from a set that are stapled or bound together in the stack as the at least one separated paper sheet is fed to the cutter elements 21 of the shredder mechanism. It can have any number of configurations.

FIG. 15 shows one embodiment wherein stripper devices 72 are provided as part of the tray 14. In particular, each stripper device 72 is provided at a back end in each corner of the tray 14. Each stripper device 72 is formed from a plurality of triangular cut-out sections. Each triangular cut-out section is cut at a predetermined angle so as to form triangular teeth in a stepped or staircase configuration. The teeth are positioned diagonally between a back and a side of the feed bed relative to the longitudinal direction of the tray 14.

Each stripper device 72 is used to strip paper sheets that are stapled together in the stack 22 from a staple (e.g., in a back left corner or a back right corner) as the paper sheets are fed to the cutter elements 21 of the shredder mechanism 20. The teeth extend into the path of which stapled sheets or documents are drawn, and apply pressure to a stapled area so that the separated sheet(s) from the stapled set can be ripped from the staple.

Papers in the paper stack 22 can be stapled together by a staple at one or two corners of the paper sheets. The stapled stack 22 can be inserted into the housing such that the staple is in the rear end of the tray 14, near or adjacent the strippers 72 in the corners. Once the shredder is activated, the helical mechanism 56 is rotated (e.g., in the view of FIG. 15, in a counter-clockwise direction) to move a pointed end of blade 66 into a stack (not shown) on the tray 14 and to separate at least an edge of at least one paper sheet therefrom (i.e., a sheet that is attached by a staple to a set of sheets) by directing the separated sheet(s) between the blade 66 and surface 63 and along lower structure 68. As a sheet(s) of a stapled document is grasped by the paper stack separation and advancement mechanism 32 and pulled into the cutter elements 21, the angled edges of at least one tooth of either or both of the strippers 72 intercede by holding or providing resistance to the staple of the stapled set. Thus, the device 72 can cooperatively provide resistance to at least an edge of the document, at or near the staple, allowing for the paper sheet(s) to be stripped from the stapled edge. As each sheet is grasped and fed toward the shredder mechanism 20, the sheet is removed from the remainder of the stapled document. In accordance with an embodiment, a separated bottom sheet(s) is pulled off of a staple as a tooth from one of the stripper devices 72 holds the staple. The interleaving cutter elements 21 together grasp the separated sheet(s) between them and continue the feeding and shredding.

Each stripper device 72 can be used (along with helical mechanism 56) to separate any number of sheets. In one embodiment, each stripper device 72 is configured to separate five (5) or more sheets.

The orientation of the sheets when using stripper devices 72 may be such that stapled documents/sheets are placed in the tray 14 with the direction of the staples being adjacent either or both of the back corners of the tray 14 (i.e., at an opposite end of the tray 14 as compared to the throat 24). Despite the orientation of the staples, the devices 72 described can provide resistance to at least the staples in the back corners as sheet(s) are fed into the cutter elements 21.

FIGS. 19-20*c* describe another embodiment of a staple picking support mechanism having stripper devices 74 provided adjacent to a front end of the tray 14. Each stripper device 74 is provided in the form of a hook that is configured to rotate and extend into (e.g., see FIGS. 15 and 26) and retract from (see FIG. 25) the throat 24 and thus the stack (relative to the front end of the tray 14) during the rotation of helical mechanism 56. The hooks 74 are configured to work cooperatively to ensure that a separated sheet(s) as picked by the helical mechanism 56 are pulled from stapled documents and fed into the cutter elements 21 of shredder mechanism 20. The hooks 74 are configured to separate, bend, and/or pull separated paper or sheet(s) from a stapled set of sheets when the staple is positioned toward or in the front end of the tray 14.

Figure 23:
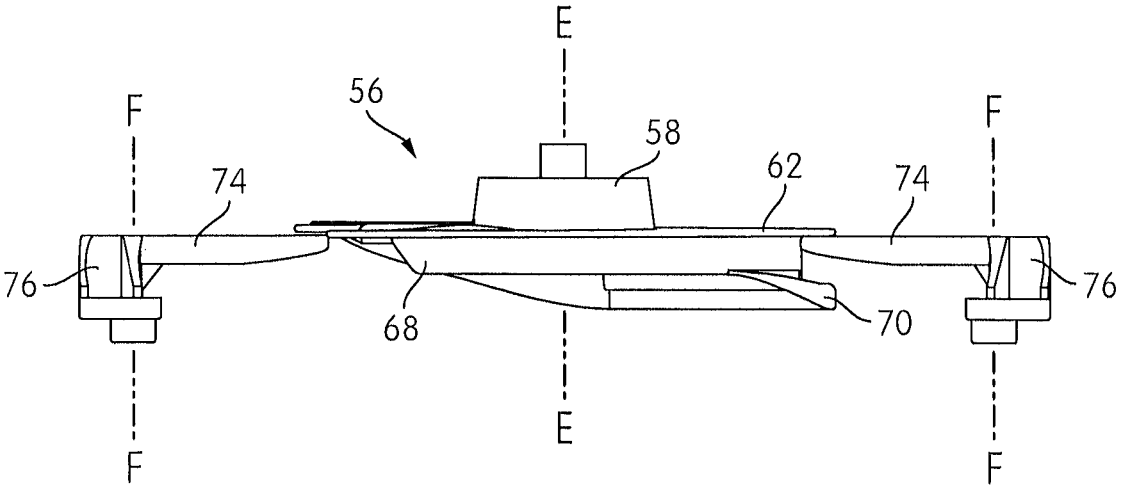
FIG. 23 shows an end view of the mechanism and pickers of FIG. 22.

As shown in FIGS. 23, a hook 74 is provided on either side of the helical mechanism 56. Thus, the hooks 74 are provided near either side or near the ends of the throat 24 (e.g., near the corners and edges of papers that may be stapled together in a corner). Each hook 74 includes a body 76 that is configured to pivot about a shaft 82 and about an axis F-F into and out of throat 24. Each axis F-F of each hook 74 is substantially parallel to axis E-E (see FIG. 23) and is substantially perpendicular to the axes (A1 and A2, not shown) of the cutter elements 21. The direction of rotation of each hook 74 about its axis F-F can depend on the position of the blade 66. For example, the hooks 74 are configured to pivot about axes F-F in a direction opposite and away from each other when deploying to their extended positions, and pivot about axes F-F towards each other when moving to their retracted positions. Using the position of the blade 66 as shown in the drawings, e.g., such that its pointed separation edge is facing the right as shown in FIG. 15, the hook 74 on the left side of helical mechanism 56 in FIG. 15 is configured to rotate in a counter-clockwise direction when moving into its extended position, while the hook 74 on the right side of helical mechanism is configured to rotate in a clockwise direction. One of ordinary skill in the art can understand how to adjust the direction of pivotal rotation based on the direction of the pointed separation edge of the blade 66 and the direction of rotation of the helical mechanism 56, and thus further description is not provided here.

The drive system 13 of the cutter elements 21 can also be constructed to move each hook 74 in an alternating manner between its retracted and extended positions as the helical mechanism 56 of the paper stack separation mechanism rotates to penetrate the stack to pick or separate paper for feeding to the cutter elements. In one embodiment, as the body 58 is driven by the motor, e.g., by rotating shaft 64, the hooks 74 are moved between their retracted and extended positions.

Figure 22:
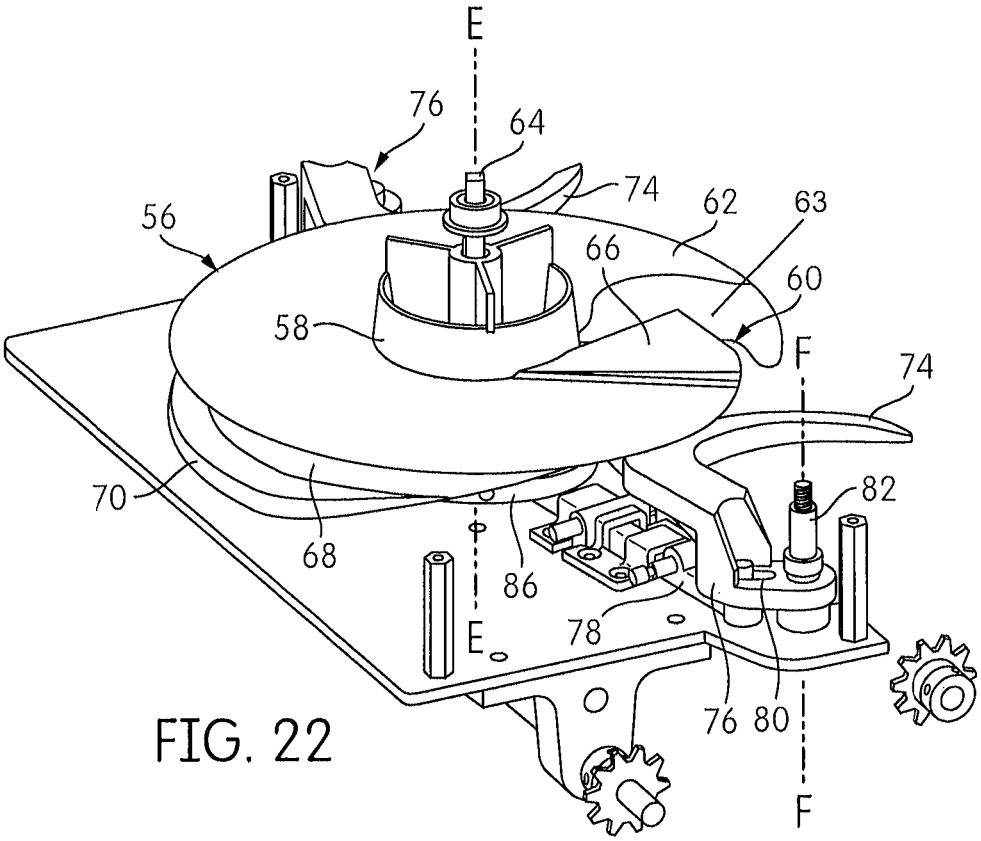
FIG. 22 shows a perspective view of the paper stack separation mechanism of FIGS. 14 and 15 and front staple pickers in accordance with an embodiment.
Figure 24:
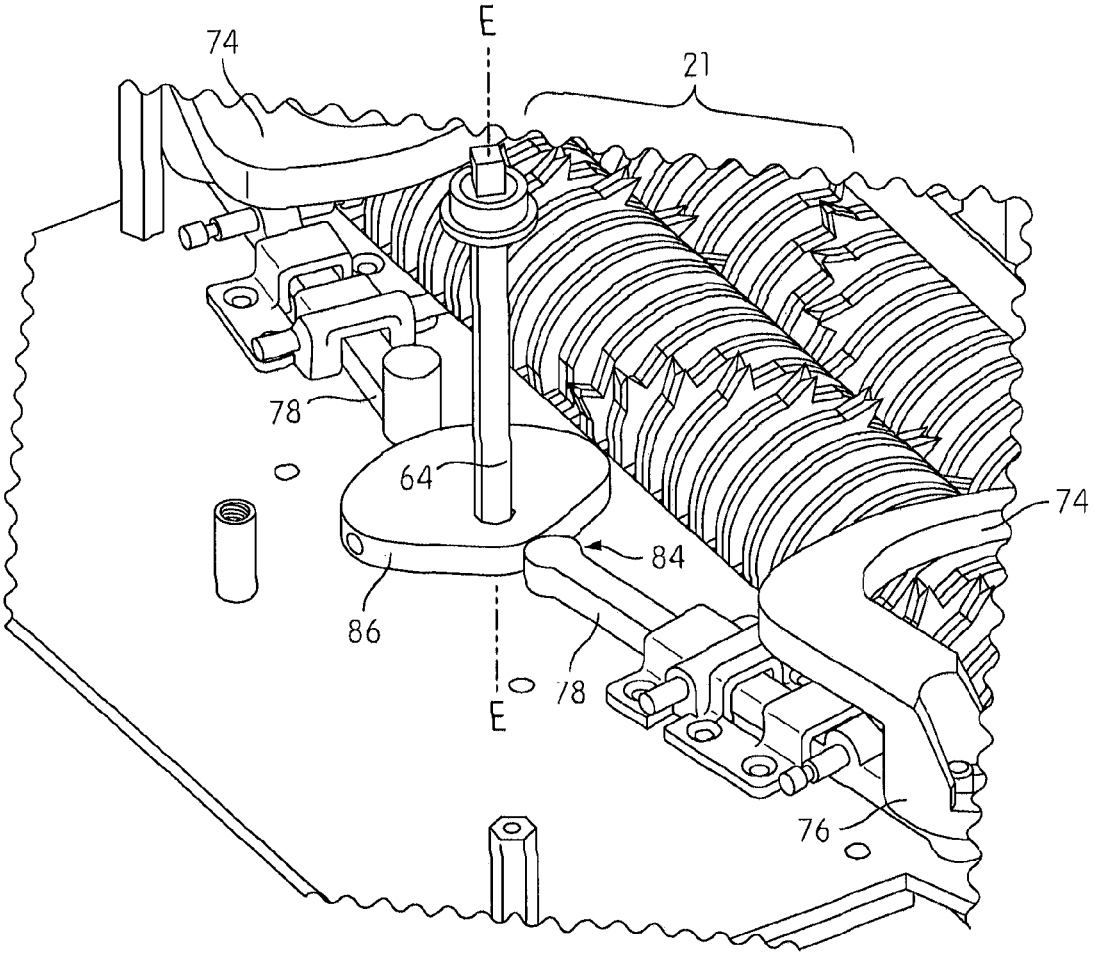
FIG. 24 shows a perspective view of the mechanical parts used to move the front staple pickers of FIG. 22 relative to the paper stack separation mechanism.

As shown in detail in FIGS. 22 and 24, the body 76 of each hook 74 is operatively connected to an arm 78. Although these Figures show details relating to one hook 74 on one (e.g., right) side of the stripper device, it should be understood that the hook 74 on the opposite (e.g., left) side has a substantially similar configuration and operates in a similar manner. The arm 78 and hook 74 are secured (e.g., via brackets) within the shredder housing. A first end portion of the arm 78, e.g., in the form of a pin, extends into an elongated slot 80 provided in the body 76 of hook 74. As further described below, movement of arm 78 moves the hook 74 between its extended and retracted positions by moving the end portion within the elongated slot 80.

Rotation of the shaft 64 can drive a cam 86, shown in detail in FIG. 24, to revolve so that an end 84 of the arm 78 is moved in a reciprocal manner around the cam 86. The arm 78 moved so that the pin can be alternated in the slot 80 of the body 76 of the hook 74. As the arm 78 moves around the cam 86, the hook 74 is moved towards and away from stack 22 in the tray 14. Thus, hooks 74 are activated via motion of shaft 64. The movement of the shaft 64 results in the alternating rotational motion of the hooks 74. Accordingly, when the shaft 64 revolves in a circle about its axle on axis E-E based on movement of the drive system 13, the arm 78 revolves about cam 86 to pivot hooks 74 about its axle, resulting in the hooks 74 being rotated between their retracted and extended positions into the stack.

The motion of one of the hooks 74 can be individually adjusted to have a mechanical delay based on the position of the blade 66 on the helical mechanism 56. That is, the position of the blade 66 as shown in the drawings, e.g., such that its pointed separation edge is facing the right as shown in FIG. 15, determines the rotation of the hooks into the throat 24 and thus into the stack. Accordingly, the timing of the rotation can be dependent upon a mounting position and direction of the blade 66. For example, the hook 74 on the left side of the helical mechanism, as shown FIG. 22, can lag for a period of time slightly behind the hook 74 on the right side, based on the rotation of the blade 66, and to insure that paper is separated from a stapled set to form a gap (as described below) and bent downwardly towards the cutter elements. As shown in FIG. 24, the cam 86 is shaped such that the arm 78 on the left side moves around the cam 86 at a different rate of than that of the arm 78 on the right side. So, the hook 74 on the left side stays for a period of time before moving between the retracted and extended positions. The stay or delay in movement for a period of time as the direction of movement of the cam 68 changes assists in stably picking and feeding paper sheets.

Figure 25:
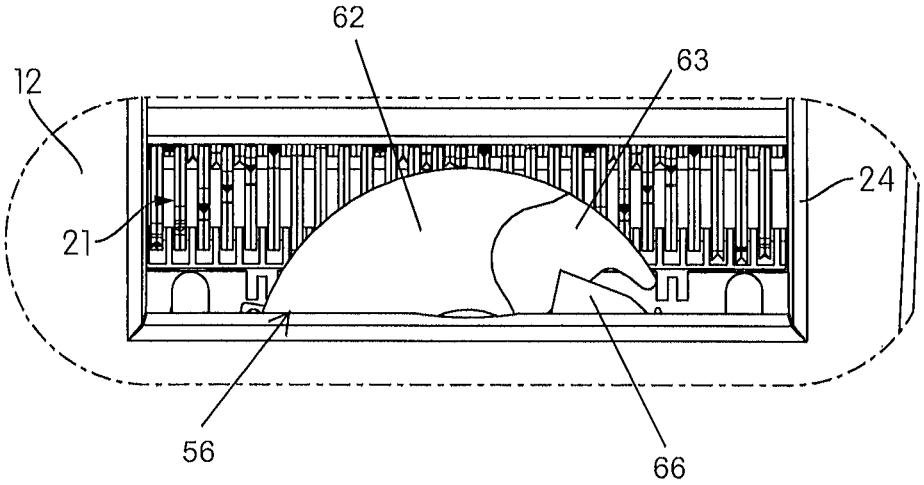
FIGS. 25 and 26 show a detailed top view of relative positions of the paper stack separation mechanism and front staple pickers during a shredding cycle.
Figure 26:
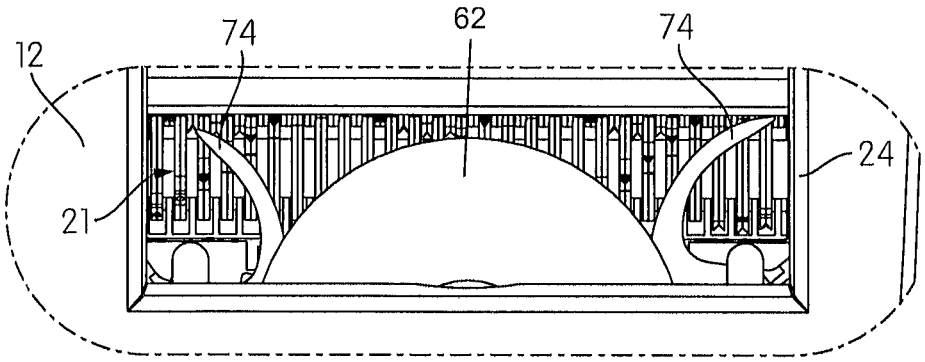

FIGS. 25 and 26 show overhead views of relative positions of the paper stack separation mechanism and hooks 74 during a shredding cycle during automatically picking and feeding at least one sheet from paper sheets that are stapled together in the paper stack 22, when the staple is in the front end of the tray 15, into the cutter elements 21. In accordance with an embodiment, since the blade 66 of helical mechanism 56 is biased to one side, the timing of the hooks is designed and biased based on the rotation of body 58. The hooks 74 of the front stripper device are configured to rotate relatively in an opposite direction away from each other during extension or deployment into the throat 24 so they can work cooperatively with the blade 66 to pick and separate at least one sheet from the bottom of a stack on the tray 14 and guide it along lower portion 68 towards the cutter elements 21.

At an initial start of the shredding cycle, the hooks 74 of the stripper device are in a retracted position away from the throat 24, as shown in FIG. 25. The helical structure 62 is rotated (e.g., in this view in FIG. 25, in a counter-clockwise direction) to rotate a pointed end of blade 66 into a stack (not shown) on the tray and to separate at least an edge of at least one paper sheet therefrom (i.e., a sheet that is attached by a staple to a set of sheets) by directing the separated sheet(s) between the blade 66 and surface 63 and along lower structure 68. The hooks 74 are also rotated (e.g. via the cam 86 and arm 78 interaction, described above). As the sheet(s) is separated and as the helical structure 62 continues to rotate, the sheet is split and bent downwardly away from the rest of the stapled set of sheets, creating a gap between the separated sheet(s) and the stapled sheets in the tray. The hooks 74 are pivoted about their axes and moved towards their extended position and into this gap. For example, as shown in FIG. 23, the hook 74 on the left side of helical mechanism 56 is rotated about axis F-F in counter-clockwise direction from its retracted position towards its extended position, while the hook 74 on the right side of helical mechanism 56 is rotated about axis F-F in clockwise direction into its extended position. The motion of the hooks 74 can be mechanically delayed such that the hook on the right side first enters the stack followed by the insertion of the hook 74 on the left side into the stack (e.g., after blade 66 is rotated past the hook 74).

As the separated sheet(s) is guided into the cutter elements 21 of the shredder mechanism 20 by the rotation of the helical mechanism 56, the hooks 74 are rotated and moved into their fully extended position via movement of the arms 78 around the cam 86, as shown in FIG. 26, to hold the separated stapled set of paper in the tray 14 from the separated sheet(s). As the sheet(s) is pulled downwardly, the hooks 74 support the stapled set of sheets in the tray 14 as the helical structure 62 rotates and advances at least an edge of the separated paper into the cutter elements 21. By pulling the separated paper downwardly therein, the cutter elements 21 apply enough force or pressure to the separated sheet(s), thus separating and ripping the separated sheet(s) from a staple at a corner of the stapled stack due to the non-picked paper of the stapled set of sheets (in the tray 14) being supported by the hooks 74. The hooks 74 prevent the non-picked paper of the stapled set of sheets from being dragged downwardly into the cutters. thus removed from the set. The hooks 74 prevent the staple or the rest of the stapled set from passing with the paper into the cutter elements 21. The interleaving cutter elements 21 together grasp the separated sheet(s) between them and continue the feeding and shredding.

Then, the hooks 74 prepare to rotate backward in an opposite direction about axis F-F towards their retracted position. As the helical mechanism 56 of the paper stack separation and advancement mechanism 32 is being fully rotated (e.g. 360 degrees), and the blade 66 is moved around via the shaft 64, the hooks 74 are pivoted in an opposite direction about axis F-F back to their retraced positions, as the arms 78 continue moving about cam 86. For example, as shown in FIG. 23, the hook 74 on the left side of helical mechanism 56 is rotated about axis F-F in clockwise direction from its fully extended position towards its retracted position, while the hook 74 on the right side of helical mechanism 56 is rotated about axis F-F in counter-clockwise direction into its retracted position. Again, the motion of the hooks 74 back into their retracted position can have momentary mechanical delay for a period of time (e.g., hook 74 on the left side of FIG. 22 is moved into its fully retracted position before hook 74 on the right side is). Then, the blade 66 prepares to move into the stack on the tray 14 as the blade 66 is helical mechanism 56 is rotated towards the throat 24.

In accordance with an embodiment, the lid 18 used with shredder 10 has a pressure plate 28 attached thereto. FIG. 27 shows a perspective view of lid 18 with pressure plate 28 associated with the paper stack separation and advancement mechanism 32 as shown in FIGS. 14-26. Accordingly, the description of features of mechanism 32, staple picking support mechanism 72 and 74, and the like are not repeated here. However, the lid 18 shown in FIG. 27 can be used in a shredder having any of the herein disclosed paper stack separation and advancement mechanisms.

Referring back to FIG. 27, in accordance with an embodiment, a pressure plate 28 is mounted within housing 20 for movement relative to the stack 22 of paper sheets in or on the tray 14. Pressure plate 28 is configured to apply pressure to at least a top sheet of the stack 22. Pressure plate 28 can be mounted to lid 18 via resilient devices 26, such as springs. Pressure plate 28 can assist by assuring that a thickness of the sheets or a number of articles picked up by the paper stack separation and advancement mechanism is substantially accurate. When the lid 18 is in the open position, the pressure plate 28 moves with the lid 18 and is automatically positioned under and adjacent to the lid 18, so it is convenient for the user to put the paper on the stack 22 into the tray 14. When the lid 18 is in the closed position, the pressure plate 28 can touch or engage paper of the stack 22, for example, and apply downward force to the stack 22 to secure any loose pages and keep the stack together.

The separation and advancement mechanisms for "automatically" feeding one or more sheets as described in the herein disclosed embodiments for use in a shredder 10 ideally allow a user to drop off a stack of paper sheets or documents without having the need to manually feed individual or a present quantity of sheets into the shredder 10. For example, a user would add a stack of documents to the tray 14 and be able to walk away. The shredder 10 may then either automatically engage in shredding the documents in the tray 14 (e.g., upon closure of the lid 18, activation of a switch, or via sensors), or set a preset timer so as to delay the time the shredder 10 is activated for the shredding process to begin. A user may also activate the shredding process by pushing a button.

One advantage of the described separation and advancement mechanisms in shredder 10 is the decreased amount of time a user must spend shredding documents, thus efficiency of operations can be improved. For example, the productivity of a user would be improved since the user is able to perform other tasks while the shredder 10 is activated. Another advantage is that the shredder 10 is designed to handle paper or documents of different sizes, textures, shapes, and thicknesses, including letter, legal, and A4 size paper, as well as envelopes and stapled sheets, for example. The documents may also be in any order.

Uncertainty with regard to other feed systems is also reduced and/or eliminated. For example, in known systems, an amount of paper sheets being fed is uncertain, so it is easier to overload the cutter elements and cause problems such as paper jams. With the herein disclosed devices, such problems are reduced; before the paper is fed, the paper stack separation and advancement mechanism rotationally inserts itself into the stack so that a smaller part of paper is separated from the other part of the stack. This separated part of paper is fed into the shredding mechanism. It also lets paper advance freely into the cutter elements. Any overload problem with regards to an amount of fed paper sheets is reduced and/or resolved.

Optionally, the shredder 10 may be utilized in a system having a centrally located shredder unit for a multitude of users. For example, the shredder 10 allows for each individual to save what they need to shred at a later time in their own individual tray. An individual can fill his or her own tray until shredding is needed. Each individual may then insert the tray into the shredder 1. In an embodiment, each individual tray may comprise a locking mechanism, such that documents may be secured within the tray, as well as to the work area of the individual, for additional security of the documents to be shredded.

The shredder 10 may also be utilized in a system wherein users use a mobile cart device to pick up items to be shred, for example. The cart device may be used to pick up individual trays or allow users to securely add documents that need to be shredded to a locked tray. Thus, other users or services may be used to shred documents without having access to such documents.

While the principles of the disclosure have been made clear in the illustrative embodiments set forth above, it will be apparent to those skilled in the art that various modifications may be made to the structure, arrangement, proportion, elements, materials, and components used in the practice of the disclosure. For example, it should be understood that, although not shown, it is within the scope of this disclosure to combine parts of the embodiments shown in FIGS. 3 and 10. In one embodiment, a helical mechanism 34 as shown in FIG. 3 may be provided at an end of the tray 14. One or more coils may be positioned for vertical rotation along a side edge of the tray, for example, to assist in separation of the stack 22 therein.

It will thus be seen that the objects of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A shredder comprising:

a housing;

a paper shredder mechanism received in the housing and including a motor and cutter elements, the motor rotating the cutter elements in an interleaving relationship for shredding paper sheets fed therein, the cutter elements configured for rotation about parallel and horizontal axes;

a tray for holding a stack of paper sheets to be fed into the cutter elements;

a paper stack separation mechanism positioned adjacent to the tray and comprising a rotatable body configured for rotation relative to the stack, the rotatable body configured such that rotation thereof in an advancing direction causes insertion of at least part of the rotatable body into at least part of the stack to separate at least an edge of at least one paper sheet therefrom and advance the at least one separated paper sheet towards the cutter elements, the rotatable body being rotatable about a rotational axis that is substantially perpendicular to the axes of the cutter elements, and a drive system constructed to drive the paper stack separation mechanism by rotating the rotatable body thereof in the advancing direction for said separating and advancing of the at least one separated paper sheet from the stack and towards the cutter elements.

2. The shredder according to claim 1, wherein the paper stack separation mechanism comprises at least one helical mechanism as the rotatable body configured for rotation about the rotational axis and comprising at least one space configured for receipt of at least one separated paper sheet from the stack.

3. The shredder according to claim 2, wherein the at least one space varies in width along a length of the at least one helical mechanism.

4. The shredder according to claim 3, wherein the width of the space gradually increases from a first end of the helical mechanism spaced distally from the shredder mechanism towards a second end of the helical mechanism spaced proximally to the shredder mechanism.

5. The shredder according to claim 2, wherein the at least one helical mechanism is a coil comprising two or more loops or turns having the at least one space therebetween.

6. The shredder according to claim 2, wherein the at least one helical mechanism comprises a shaft configured for rotation about the rotational axis and at least one radially extending structure comprising turns positioned concentrically around and extending perpendicularly from the shaft with the at least one space therebetween, the at least one radially extending structure configured to extend into the stack.

7. The shredder according to claim 6, wherein the at least one radially extending structure is provided around the shaft in a substantially conical configuration.

8. The shredder according to claim 1, wherein the paper stack separation mechanism is configured to separate at least a bottom sheet from the stack in the tray.

9. The shredder according to claim 1, wherein the tray comprises a bottom portion, the bottom portion of the tray comprising an edge adjacent to the paper stack separation mechanism configured to assist in directing the at least one separated paper sheet towards the cutter elements.

10. The shredder according to claim 1, further comprising a paper feed mechanism positioned adjacent to an edge of the tray for advancing the at least one separated paper sheet into the cutter elements.

11. The shredder according to claim 10, wherein the paper feed mechanism comprises rollers configured to grasp an edge of the at least one separated paper sheet therebetween.

12. The shredder according to claim 11, wherein the rollers extend along a width of the tray, adjacent to the edge thereof.

13. The shredder according to claim 1, wherein the paper stack separation mechanism is positioned at or near an edge of the tray.

14. The shredder according to claim 13, wherein the paper stack separation mechanism is positioned at or near a center line of the tray.

15. The shredder according to claim 1, wherein the paper stack separation mechanism is positioned at least partially within the tray.

16. The shredder according to claim 1, wherein the tray is substantially horizontal and the stack of paper sheets lay substantially horizontal within the tray.

17. The shredder according to claim 1, wherein the tray is substantially vertical and the stack is substantially vertical within the tray.

18. The shredder according to claim 1, wherein the drive system is activated to drive the paper stack separation mechanism by rotating the rotatable body thereof in the advancing direction based upon the rotation of the motor of the paper shredder mechanism.

19. The shredder according to claim 1, further comprising a pressure plate mounted for movement relative to the stack of paper sheets in the tray and configured to apply pressure to at least a top sheet of the stack.

20. The shredder according to claim 19, wherein the pressure plate is mounted to a lid.

21. The shredder according to claim 1, further comprising a staple picking support mechanism adjacent the paper stack separation mechanism, the staple picking support mechanism configured for stripping the at least one separated paper sheet from a set that are stapled together in the stack as the at least one separated paper sheet is fed to the cutter elements.

22. The shredder according to claim 1, wherein the paper stack separation mechanism is provided at a front end of the tray and further comprising a staple picking support mechanism at a rear end of the tray for stripping the at least one separated paper sheet from a set that are stapled together in the stack as the at least one separated paper sheet is fed to the cutter elements.

23. The shredder according to claim 20, wherein the pressure plate is mounted to the lid via one or more resilient devices.

24. The shredder according to claim 20, wherein the lid and/or the pressure plate either or both comprise an opening or slot allowing manual insertion of paper sheets into the tray.

25. The shredder according to claim 1, wherein the drive system comprises links or gears coupling the rotatable body to the motor of the shredder mechanism such that the rotation of the rotatable body in the advancing direction is driven by the motor.

26. The shredder according to claim 1, wherein the drive system comprises a motor separate from the motor of the shredder mechanism for rotating the rotatable body in the advancing direction.

27. The shredder according to claim 1, further comprising a paper feed mechanism between the paper stack separation mechanism and the shredder mechanism for continuing to advance the at least one separated sheet into the cutter elements.

28. The shredder according to claim 27, wherein the paper feed mechanism comprises rollers configured to grasp an edge of the at least one separated paper sheet therebetween.

29. The shredder according to claim 28, wherein the rollers extended along a width of the tray, adjacent to an edge thereof.

30. A shredder comprising:

a housing;

a paper shredder mechanism received in the housing and including a motor and cutter elements, the motor rotating the cutter elements in an interleaving relationship for shredding paper sheets fed therein, the cutter elements configured for rotation about parallel and horizontal axes;

a tray for holding a stack of paper sheets to be fed into the cutter elements;

a paper stack separation mechanism positioned adjacent to the tray, the paper stack separation mechanism configured for insertion into at least part of the stack and rotation to separate at least an edge of at least one paper sheet therefrom and for advancing the at least one separated paper sheet towards the cutter elements, the paper stack separation mechanism configured for rotation about a rotational axis that is substantially perpendicular to the axes of the cutter elements, and a drive system constructed to drive the paper stack separation mechanism in an advancing direction to advance the at least one separated paper sheet from the stack and towards the cutter elements, wherein the paper stack separation mechanism comprises at least one helical mechanism configured for rotation about the rotational axis and comprising at least one space configured for receipt of at least one separated paper sheet from the stack.

31. The shredder according to claim 30, wherein the at least one helical mechanism comprises a shaft configured for rotation about the rotational axis and at least one radially extending structure comprising turns positioned concentrically around and extending perpendicularly from the shaft with the at least one space therebetween, the at least one radially extending structure configured to extend into the stack.

32. The shredder according to claim 31, wherein the at least one radially extending structure is provided around the shaft in a substantially conical configuration.

33. The shredder according to claim 30, wherein the paper stack separation mechanism is positioned at or near an edge of the tray.

34. The shredder according to claim 30, wherein the tray is substantially horizontal and the stack of sheet material lay substantially horizontal within the tray.

35. The shredder according to claim 30, wherein the stack separation mechanism is provided at a front end of the tray and further comprising a staple picking support mechanism at a rear end of the tray for stripping the at least one separated paper sheet from a set that are stapled together in the stack as the at least one separated paper sheet is fed to the cutter elements.

36. A shredder comprising: a housing; a shredder mechanism received in the housing and including a motor and cutter elements, the motor rotating the cutter elements in an interleaving relationship for shredding articles fed therein, the cutter elements configured for rotation about parallel and horizontal axes; a tray for holding a stack of articles to be fed into the cutter elements; a stack separation mechanism positioned adjacent to the tray and comprising a rotatable body configured for rotation relative to the stack, the rotatable body configured such that rotation thereof in an advancing direction causes insertion of at least part of the rotatable body into at least part of the stack to separate at least an edge of at least one article therefrom and advance the at least one separated article towards the cutter elements, the rotatable body being rotatable about a rotational axis that is substantially perpendicular to the axes of the cutter elements, and a drive system constructed to drive the stack separation mechanism by rotating the rotatable body thereof in the advancing direction for said separating and advancing of the at least one separated article from the stack and towards the cutter elements.

37. The shredder according to claim 36, wherein the stack separation mechanism comprises at least one helical mechanism as the rotatable body configured for rotation about the rotational axis and comprising at least one space configured for receipt of at least one separated article from the stack.

38. The shredder according to claim 37, wherein the at least one helical mechanism comprises a shaft configured for rotation about the rotational axis and at least one radially extending structure comprising turns positioned concentrically around and extending perpendicularly from the shaft with the at least one space therebetween, the at least one radially extending structure configured to extend into the stack.

39. The shredder according to claim 38, wherein the at least one radially extending structure is provided around the shaft in a substantially conical configuration.

40. The shredder according to claim 36, wherein the stack separation mechanism is positioned at or near an edge of the tray.

41. The shredder according to claim 36, wherein the tray is substantially horizontal and the stack of article material lay substantially horizontal within the tray.

42. The shredder according to claim 36, wherein the stack separation mechanism is provided at a front end of the tray and further comprising a staple picking support mechanism at a rear end of the tray for stripping the at least one separated article from a set that are stapled together in the stack as the at least one separated article is fed to the cutter elements.

* * * * *